US008040295B2

(12) United States Patent
Takagi et al.

(10) Patent No.: US 8,040,295 B2
(45) Date of Patent: Oct. 18, 2011

(54) PLASMA DISPLAY APPARATUS

(75) Inventors: Akihiro Takagi, Kawaguchi (JP); Tetsuya Sakamoto, Yokohama (JP); Takashi Shiizaki, Yokohama (JP)

(73) Assignee: Fujitsu Hitachi Plasma Display Limited, Miyazaki-ken (JP)

( * ) Notice: Subject to any disclaimer, the term of this patent is extended or adjusted under 35 U.S.C. 154(b) by 868 days.

(21) Appl. No.: 11/672,086

(22) Filed: Feb. 7, 2007

(65) Prior Publication Data

US 2007/0236417 A1 Oct. 11, 2007

(30) Foreign Application Priority Data

Apr. 11, 2006 (JP) ..... 2006-108204

(51) Int. Cl.
*G09G 3/28* (2006.01)

(52) U.S. Cl. ..... 345/68; 345/60

(58) Field of Classification Search ..... None
See application file for complete search history.

(56) References Cited

U.S. PATENT DOCUMENTS 6,072,449 A * 6/2000 Amemiya ..... 345/67
6,278,420 B1 8/2001 Mikoshiba et al.
2002/0044107 A1* 4/2002 Lee ..... 345/60
2002/0190930 A1* 12/2002 Shiizaki et al. ..... 345/63
2004/0263425 A1* 12/2004 Anzai et al. ..... 345/1.1
2004/0263435 A1* 12/2004 Ohira et al. ..... 345/60
2005/0052353 A1* 3/2005 Shiizaki et al. ..... 345/60

FOREIGN PATENT DOCUMENTS

JP 2003-005699 1/2003
KR 1998-086932 12/1998
KR 10-2005-0098625 A 10/2005

* cited by examiner

*Primary Examiner* — Bipin Shalwala
*Assistant Examiner* — Daniel Bedell
(74) *Attorney, Agent, or Firm* — Antonelli, Terry, Stout & Kraus, LLP.

(57) ABSTRACT

In a PDP apparatus provided with a PDP having (X, Y, A) and various drivers, two adjacent Ys in a plurality of Ys are commonly connected by a wiring so as to form one set unit, in the vicinity of a connection portion of the PDP and the drivers. A two-stage reset and address operation control using a reset operation including an address disable operation is used for a control unit including a plurality of display lines (L) of the set units. In a plurality of Ls as objects of drive display, the reset and address operation of first Ls (Lo) corresponding to Ys on one side of set units and that of second Ls (Le) corresponding to Ys on the other side thereof are performed separately in former and latter periods, and then, sustain operations of the first and second Ls on both sides are performed simultaneously.

5 Claims, 24 Drawing Sheets

*FIG. 1*

| Embodi-ment | Back-ground Structure | PDP | X,Y | A | TS | Y Common Connection Structure | Voltage Waveform | Number of Y Bits (Conventional Technology) | Number of Y Bits (Effect) |
|---|---|---|---|---|---|---|---|---|---|
| 1 | 1 | First Structure (Normal) | XYXY (Sequen-tial) | Single | Non SSP | Two Adjacent Ys (A) | p1 | k | k/2 |
| 2 | 2 | | | | SSP | Two Ys of Every Other Y (B) | p2 | k | k/2 |
| 3 | 3 | | | Double | Non SSP | Set of Total of Four Ys Including Two Adjacent Ys on u Side and Two Adjacent Ys on d Side (C) | (u,d) p1 | k | k/4 |
| 4 | 4 | | | | SSP | Set of Total of Four Ys Including Two Adjacent Ys of Every Other Y on u Side and Two Adjacent Ys of Every Other Y on d Side (D) | (u,d) p2 | k | k/4 |
| 5 | 5 | | XYYX (Reverse) | Single | SSP | Two Adjacent Ys (A) | p3 | k | k/2 |
| 6 | 6 | | | Double | SSP | Set of Total of Four Ys Including Two Adjacent Ys on u Side and Two Adjacent Ys on d Side (C) | (u,d) p3 | k | k/4 |
| 7 | 7 | Second Structure (ALIS) | XYXY (Alternate) | Single | SSP | Two Ys of Every Other Y (B) | p4,p5 | k/2 | k/4 |
| 8 | 8 | | | Double | SSP | Set of Total of Four Ys Including Two Adjacent Ys of Every Other Y on u Side and Two Adjacent Ys of Every Other Y on d Side (D) | (u,d) p4,p5 | k/2 | k/8 |

k: Number of Display Lines

*FIG. 20*

(6)

| y | L | X/Y | All F-SF : Same p3 in (u,d) | | | | | | |
|---|---|---|---|---|---|---|---|---|---|
| | | | TR1 | TA1 | | TR2 | | TA2 | TS |
| u | L1 | X1 | △ | ○ | ○ | △ | × | × | ○ |
| y1 | | Y1 | △ | | | △ | | | |
| | L2 | Y2 | △ | × | × | | ○ | ○ | ○ |
| | | X2 | △ | | | | | | |
| | L3 | X3 | △ | ○ | ○ | △ | × | × | ○ |
| y2 | | Y3 | △ | | | △ | | | |
| | L4 | Y4 | △ | × | × | | ○ | ○ | ○ |
| | | X4 | △ | | | | | | |
| | | X5 | | | | | | | |
| | | ⋮ | | | | ⋮ | | | |
| d | Ln+1 | Xn+1 | △ | ○ | ○ | △ | × | × | ○ |
| | | Yn+1 | △ | | | △ | | | |
| | Ln+2 | Yn+2 | △ | × | × | | ○ | ○ | ○ |
| | | Xn+2 | △ | | | | | | |
| | Ln+3 | Xn+3 | △ | ○ | ○ | △ | × | × | ○ |
| | | Yn+3 | △ | | | △ | | | |
| | Ln+4 | Yn+4 | △ | × | × | | ○ | ○ | ○ |
| | | Xn+4 | △ | | | | | | |
| | | Xn+5 | | | | | | | |
| | | ⋮ | | | | ⋮ | | | |

PLASMA DISPLAY APPARATUS

CROSS-REFERENCE TO RELATED APPLICATION

The present application claims priority from Japanese Patent Application No. JP 2006-108204 filed on Apr. 11, 2006, the content of which is hereby incorporated by reference into this application.

TECHNICAL FIELD OF THE INVENTION

The present invention relates to a driving method of a plasma display panel (PDP) and a technology for a display apparatus (plasma display apparatus: PDP apparatus) in which moving images are displayed on the PDP. More particularly, it relates to operations such as a reset operation, an address operation and a sustain operation in the driving method (system and method) of the PDP.

BACKGROUND OF THE INVENTION

As the structures of the conventional PDP and the PDP apparatus, a commonly-used structure where a display line (L) formed of a set of a sustain electrode (X) and a scan electrode (Y) to be display electrodes (D) and extending in a lateral (first) direction is formed repeatedly (first structure) and a structure where a sustain electrode (X) and a scan electrode (Y) are arranged alternately and display lines (L) are formed of all of the adjacent sustain electrodes (X) and scan electrodes (Y) to be display electrodes (D) (second structure, corresponding to so-called ALIS structure) have been known. In the second structure, an odd-numbered (o) display line (Lo) is formed of a pair of a Y and an X on an upper side thereof and an even-numbered (e) display line (Le) is formed of a pair of the Y and an X on a lower side thereof, and the Y at the center is shared and used for the scan operation in the two adjacent Ls (that is, three Ds).

Further, in a PDP apparatus of the second structure, an interlace driving method is particularly used as its driving method, in which odd-numbered and even-numbered display lines (Lo, Le) are driven and displayed alternately in terms of time. A side to be driven and displayed is called a positive slit (positive side) and a side not to be driven and displayed is called a reverse slit (reverse side).

Further, with regard to the structure of barrier ribs (ribs) in a PDP, a structure where barrier ribs extending in a longitudinal (second) direction are arranged (stripe shape ribs) and a structure where barrier ribs are arranged into a grid shape so as to extend also in a lateral direction (grid shape ribs) have been known. Also, as the structures of the arrangement of Ds (X, Y) in a PDP of the first structure, a structure where X and Y are sequentially repeated such as {(X, Y), (X, Y) . . . } and a structure where pairs of (X, Y) and (Y, X) are sequentially repeated so that an X is adjacent to another X of an adjacent pair and a Y is adjacent to another Y of an adjacent pair such as {(X, Y), (Y, X), (X, Y) . . . } have been known. Further, as a sustain driving method in the PDP of the first structure, a method where adjacent Ds of the reverse slit are set to have the same phase (SSP) and a method where Xs are set to have the same phase and Ys are set to have the same phase (non SSP) have been known.

Further, the structures of address electrodes (A) in PDP of the first and second structures include the following first and second A structures. In the first A structure, one ends of a plurality of As extending approximately in parallel to the longitudinal direction are connected to an address driving circuit (single (one side) A structure). In the second A structure, a plurality of As are divided into two types (Au, Ad) in the upper and lower areas (u, d) of PDP and the two types of As are connected to respectively different address driving circuits, and they (Au, Ad) can be driven from both the sides (double (both side) A structure). In the former, for driving a plurality of (for example, n lines of) Ys, scan pulses are applied to the Ys from the top (first line) to the bottom (n-th line) of the PDP. In the latter, for example, in a group of Ys including (1 to n/2) lines of Ys in the upper area (u) (Yu) and a group of Ys including (n/2+1 to n) lines of Ys in the lower area (d) (Yd), address operation can be simultaneously performed to different two Ys.

Further, a driving circuit (driver) for driving each electrode of a PDP is mounted by an IC (semiconductor integrated circuit) board. Electrodes of a PDP (in particular, bus electrodes) and output terminals of a driver (driver IC) are electrically connected via a connection portion. For example, the ends of the Ys of a PDP and the output terminals of a driving circuit to Y (Y driver) are connected by wirings of a flexible printed circuit board (FPCB) serving as a connection portion.

Furthermore, as a driving method used in a PDP apparatus of the second structure, Japanese Patent Application Laid-Open Publication No. 2003-5699 (Patent Document 1) discloses a progressive driving method by two-stage reset and address operation having address disable operation. In this technology, as the address disable operation, one of adjacent Ls is put into a charge state where address discharge can be made, and the other L is put into a charge state where address discharge does not occur. Then, address discharge is generated in the one of adjacent Ls. By this means, progressive drive is performed.

SUMMARY OF THE INVENTION

In the conventional technology mentioned above, as the number of bits of Y driver (hereinafter referred to as the number of Y bits), a number of bits equivalent to the number of Ys, that is, the number of Ls (k) are required in the case of the commonly-used first structure. Further, a number of bits equivalent to half number of Ys, that is, half number of Ls (k) are required in the case of the second structure. The number of Y bits is associated with the number of Y driver output terminals, the number of wirings between the Y end portions and the Y driver output terminals of a PDP and others. In general, since the number of Y is normally provided by a value of power of 2, the above-described number of bits is considered.

Outlines of the structure and problems in the structural examples of the conventional technology (background technologies) are shown in a part of FIG. 1. Background structures 1 to 8 obtained by the combinations of the conventional technologies are shown therein. The "background structures" are represented in each column of "PDP", "X, Y" "A", "TS", and "number of Y bits (conventional technology)". In the "number of Y bits (conventional technology)", the number of necessary Y bits is represented by means of the correlation with the number of Ls (k). For example, in the background structure 1, PDP is the first structure, sequential repeated arrangement of X and Y (XYXY) is used, A is a single (one side) A structure, the method in TS (sustain period) is non SSP, and bits equivalent to the number of Ls (k) are required as the number of Y bits (conventional technology). Further, for example, in the background structure 8, PDP is the second structure, alternate repeated arrangement of X and Y is used, A is a double A structure, the method in TS is SSP, and bits equivalent to half number of L (k) (k/2) are required as the number of Y bits (conventional technology). As for the number of Y bits (conventional technology), bits equivalent to the number of Ys are required, and bits equivalent to the number of Ls (k) are required in the background technologies 1 to 6 having the first structure, and bits equivalent to half number of Ls (k/2) are required in the background technologies 7 and 8 having the second structure.

Along with the increase in definition in the PDP, the number of Ys and the number of Ls are increased, and the number of Y bits is thus increased. As a result, the problem of the increase in the size and costs of the apparatus occurs in the conventional technologies.

The present invention has been made for the purpose of solving the above-described problem in the conventional technologies, and an object of the present invention is to provide a technology for a PDP capable of reducing the size and costs of an apparatus particularly by reducing the number of Y bits.

The typical ones of the inventions disclosed in this application will be briefly described as follows. In order to achieve the above-mentioned object, according to one aspect of the present invention, a technology for a PDP apparatus is provided, which is obtained by the combination of respective technologies such as the PDP having the first or second structure, single or double A structure, sequential or reverse repeated arrangement structure of X and Y, a sustain driving method of SSP or non SSP and others, and it is characterized by having technological means shown below. In particular, the technology relates to a structure of a driver for applying voltage waveform for driving to Y (Y driver), a structure of a connection portion between Ys and Y driver of a PDP and between Ys and its IC board of a PDP, a structure of connection wiring between a Y end portion and a Y driver output terminal, and others.

In a structure of a PDP apparatus of the present invention, by the technology for a PDP driving method (in particular, driving voltage waveform) and hardware structure around a connection portion corresponding thereto, a plurality of (at least two) Ys are electrically connected to each other (common connection) in the vicinity of a connection portion so that a plurality of Ys of PDP can be collectively driven in common from the Y driver side according to a driving method. In this structure, to a unit of a plurality of commonly connected Ys (Y set unit) and a control unit including a plurality of Ls corresponding thereto, the same voltage waveform for driving is applied from the Y driver side in a specified unit of time for display. By this means, the number of Y bits is reduced in comparison with that in the conventional technology.

In accordance with the structure of the Y common connection, as a driving method, this PDP apparatus is combined with the technology of a two-stage reset and address operation control (periods divided into former and latter in terms of time) for a control unit including a plurality of Ls, using a reset operation including the address disable operation (hereinafter also referred to simply as two-stage control).

For example, this PDP apparatus has a structure as follows. A PDP has D (X, Y) group extending in a first direction and A group extending in a second direction in a pair of substrates for forming discharge spaces, the Ds include Ys used for scan in an address operation and Xs not used in the scan arranged repeatedly, L is formed of a pair of adjacent Ds (X, Y), and a display cell (C) is formed at an area where L and A cross with each other. This PDP apparatus has drivers for applying voltage waveform for driving to the electrodes of PDP and a control circuit for controlling each of the drivers.

In a plurality of Ys in the PDP apparatus, in the vicinity of the connection portion between a PDP and a driver (Y driver), specified two Ys are commonly connected so as to be included in one set unit, and one voltage waveform is applied from the Y driver side to the set unit (in particular, to wiring thereof). In the entire PDP apparatus, at least one set unit is formed, typically, all Ys are formed into set units. In a specified unit of time for display such as subfield (SF), such operations as a reset operation for making preparations for an address operation, an address operation for selecting C to be lit, and a sustain operation for performing the sustain discharge in the selected C are performed.

In this PDP apparatus, in a driving control by the application of voltage waveform from a driving circuit side in respective units of time for display, the two-stage reset and address operation control using a reset operation (pulse, period or others) including the address disable operation is used to the control unit including a plurality of Ls composed of set units connected commonly of the PDP. In this control, in the plurality of Ls on the side to be driven and displayed (positive side) in the control unit, first Ls corresponding to Ys on one side (first type: o/a/p) of the set units and second Ls corresponding to Ys on the other side (second type: e/b/q) thereof are provided, and the reset and address operation of the first Ls and that of the second Ls are performed separately in the two-stage periods, that is, in the former and latter periods, respectively. Then, the sustain operation of the first and second Ls on both sides are simultaneously performed. The first type and the second type to be separately operated are changed in accordance with the details of structures and driving methods (combinations of the respective technologies).

Further, the structure of the common connection of the Ys is realized inside or outside (circuit side) a PDP. In the case where it is structured on the circuit side, a plurality of Ys are connected into one at the connection portion which electrically connects PDP end portions and Y driver output terminals. For example, they are connected by wiring of a flexible printed circuit board which electrically connects the PDP (in particular, end portions thereof) and the IC board of a driver (in particular, output terminals) or by the wiring in an end area of the IC board of a driver. Further, in the case where it is structured inside a PDP, a plurality of Ys (Y bus electrodes and others) are connected into one in the area near the end of a PDP.

Further, the structures of Y common connection corresponding to details of structures and driving methods are as below.

(Type A: (1), (5))

For example, in the case of a PDP apparatus having the first structure and single A structure, two adjacent Ys of a PDP can be scanned at the same timing by the two-stage control. Accordingly, these two adjacent Ys are formed into one set unit. In this structure, two Ys corresponding to a set unit are commonly scanned and driven by a Y bit of 1 bit. Therefore, the number of Y bits of a Y driver can be reduced by the number of Y common connections.

(Type B: (2), (7))

For example, in the case of a PDP apparatus having the first or second structure and single A structure and using the SSP, two Ys of every other Y of a PDP can be scanned at the same timing by the two-stage control. Accordingly, these two Ys of every other Y are formed into one set unit.

(Type C: (3), (6))

For example, in the case of a PDP apparatus having the first structure, double A structure, sequential repeated arrangement structure of X and Y and using the non SSP or a PDP apparatus having the first structure, double A structure, reverse repeated arrangement structure of X and Y and using the SSP, two adjacent Ys of an upper area (u) and two adjacent Ys of a lower area (d) of a PDP can be scanned at the same timing by the two-stage control. Accordingly, these two adjacent Ys of the upper and lower areas (u, d), total of four Ys are formed into one set unit.

(Type D: (4), (8))

For example, in the case of a PDP apparatus having the first or second structure, double A structure, sequential repeated arrangement structure of X and Y or alternate repeated arrangement structure of X and Y and using the SSP, two Ys of every other Y of the upper area (u) and two Ys of every other Y of the lower area (d) of a PDP can be scanned at the same timing by the two-stage control. Accordingly, these two Ys of every other Y of the upper and lower areas (u, d), total of four Ys are formed into one set unit.

Further, for example, this PDP apparatus has the structure as follows. As a unit of time for display, a plurality of subfields (SF) obtained by dividing a field of a PDP based on grayscale are provided. Each SF includes a reset period for reset operation, an address period for address operation, and a sustain period for sustain operation. The reset period and the address period are divided into first and second periods, respectively, in accordance with the two-stage control.

In the driving control, address disable operation is combined with the reset operation. In the reset operation at the first stage, the control including the address disable operation and the control not including the same are available. In the first and second reset periods or in only the second reset period, pulse for address disabling is applied to an A and Y corresponding to an objective L or a slit, thereby putting Ls or slits on both sides of the Y into an address disable state (state where address discharge does not occur unless reset discharge is generated). The polarity and voltage of the pulse to be applied to Y are the same as those of the pulse applied in the address period.

In the driving control of control unit in SF, in the period of the first stage, reset discharge which puts the above-mentioned first L on one side into a state where address discharge can be generated and puts the above-mentioned second L on the other side into a state where address discharge cannot be generated is generated in the first reset period, and then, in the first address period, address discharge is generated in the first L. Next, in the period of the second stage, reset discharge which puts the above-mentioned first L into a state where address discharge cannot be generated and puts the above-mentioned second L into a state where address discharge can be generated is generated in the second reset period, and then, in the second address period, address discharge is generated in the second L. Thereafter, in the sustain period, sustain discharge is simultaneously generated in the first and second Ls.

Further, for example, in this PDP apparatus, on the non-operated side in the above-described control, that is, on the side not to be driven and displayed (reverse L or reverse slit side), in other words, with regard to the control to the first or second L on the side where the reset operation and the address operation are not performed in the two-stage control, the generation of the discharge is suppressed as much as possible. More specifically, pulse of the same polarity and voltage is applied to the pair of Ds in the period of reset operation, thereby providing a part where reset discharge is not generated. Further, the voltage of X of the pair of Ds is set to 0 in the period of address operation, thereby providing a part where address discharge is not generated.

The effects obtained by typical aspects of the present invention will be briefly described below. According to the present invention, it is possible to reduce the size and cost of an apparatus particularly by reducing the number of Y bits.

BRIEF DESCRIPTIONS OF THE DRAWINGS

FIG. 1 is a diagram showing structural outlines (characteristics) of PDP apparatuses according to embodiments of the present invention in bulk and structural outlines of background technologies of the present invention;

FIG. 20 is a diagram showing control objects and timings in a driving method of a PDP apparatus according to the sixth embodiment of the present invention;

DESCRIPTIONS OF THE PREFERRED EMBODIMENTS

Figure 2:
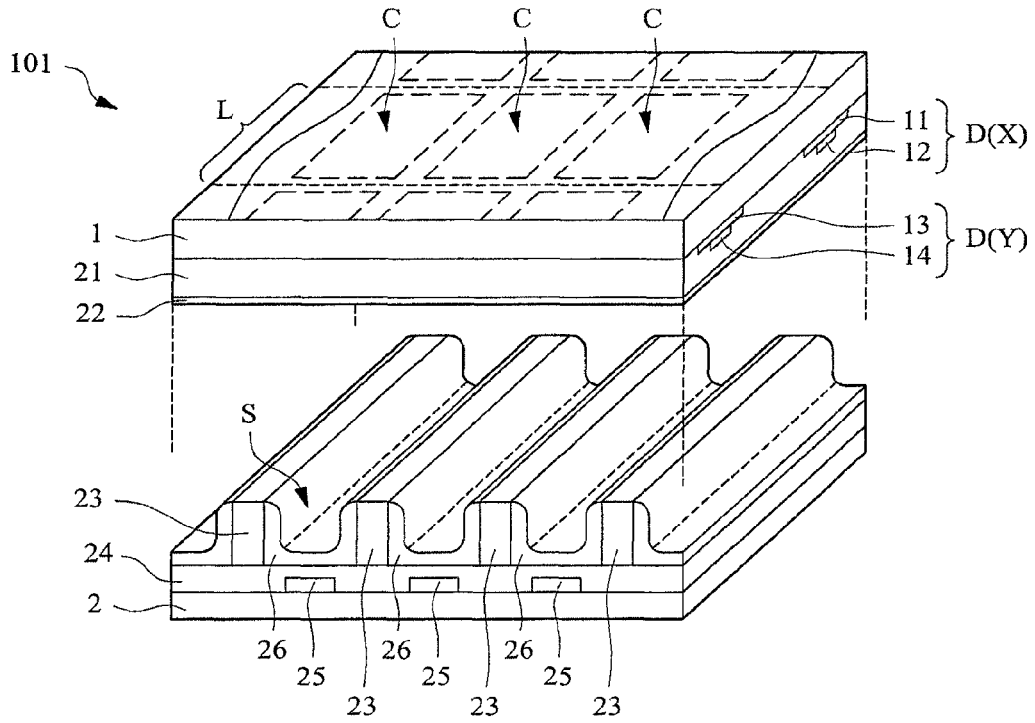
FIG. 2 PRIOR ART
FIG. 2 is a perspective view showing an exploded structure of a PDP in a PDP apparatus according to an embodiment of the present invention.
Figure 3:
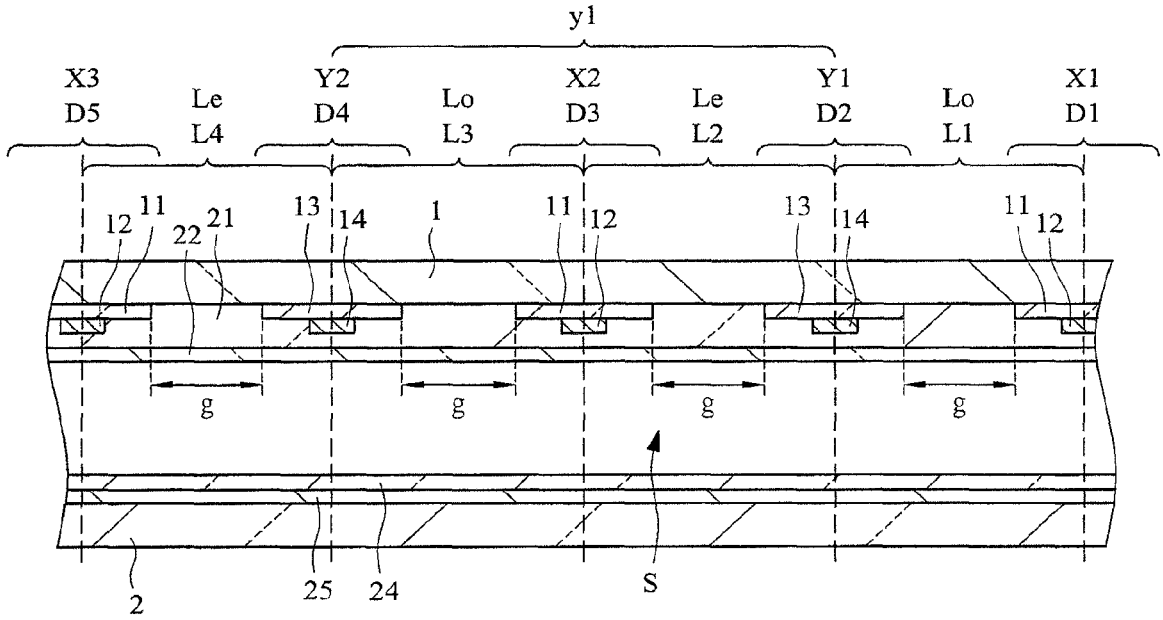
FIG. 3 PRIOR ART
FIG. 3 is a cross sectional view showing a structure in a longitudinal direction along address electrodes of a PDP in a PDP apparatus according to an embodiment of the present invention.
Figure 4:
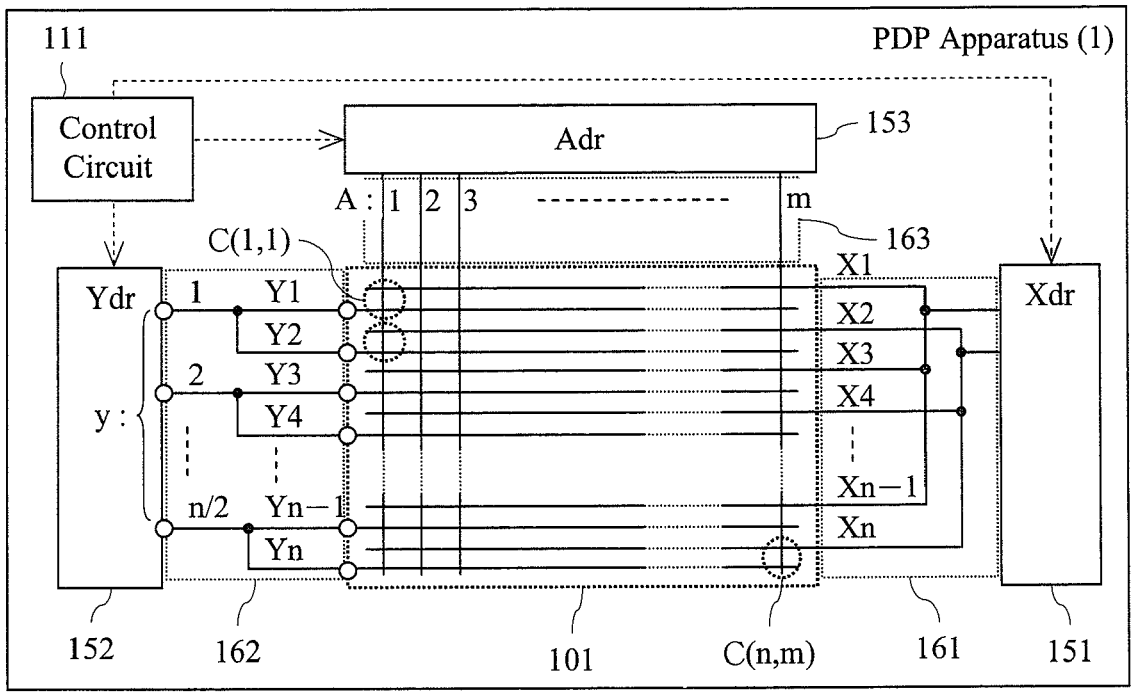
FIG. 4 is a diagram showing a schematic structure in a PDP apparatus (first structure, single A structure) according to an embodiment of the present invention.
Figure 5:
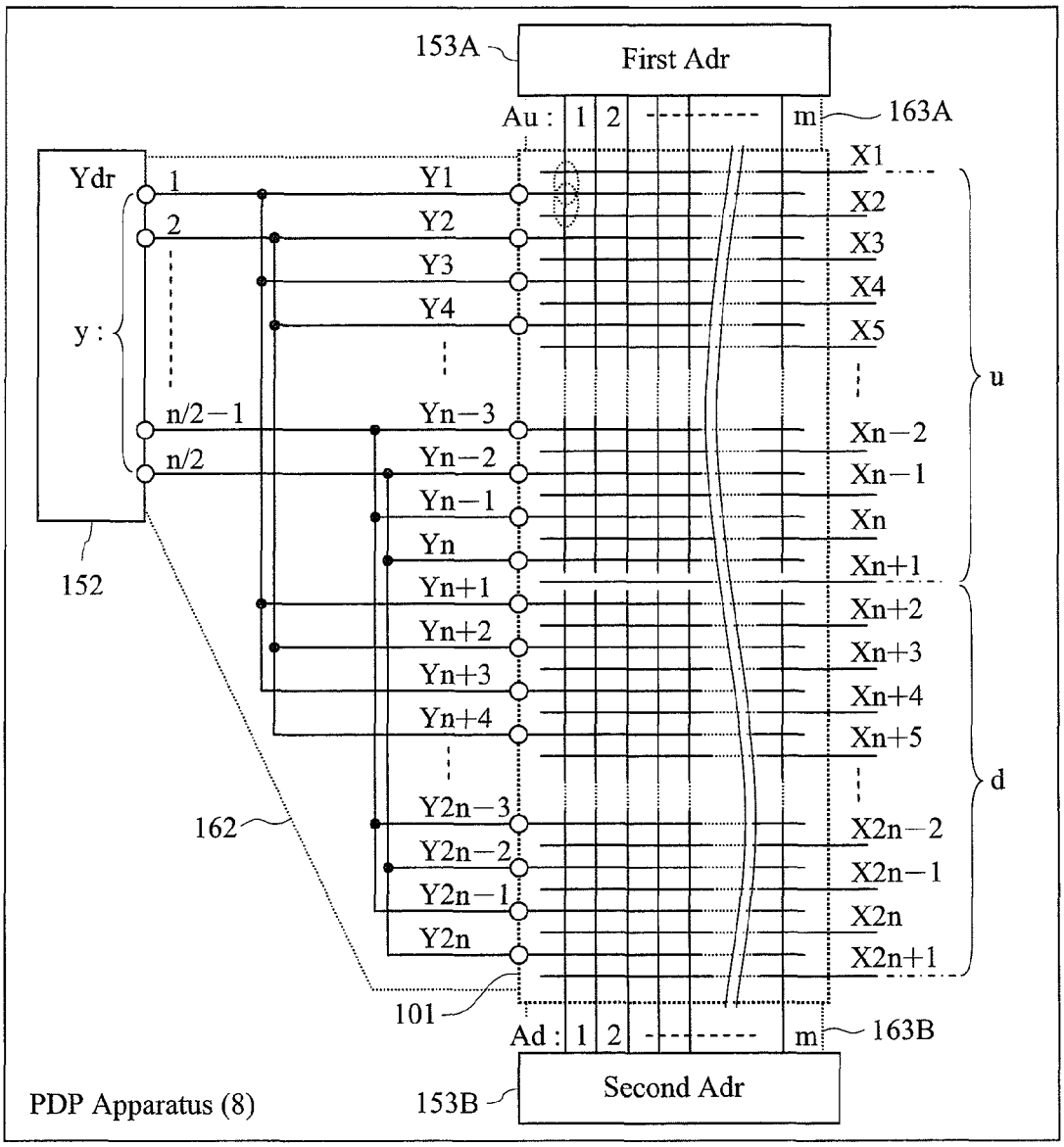
FIG. 5 is a diagram showing a schematic structure in a PDP apparatus (second structure, double A structure) according to an embodiment of the present invention.
Figure 6:
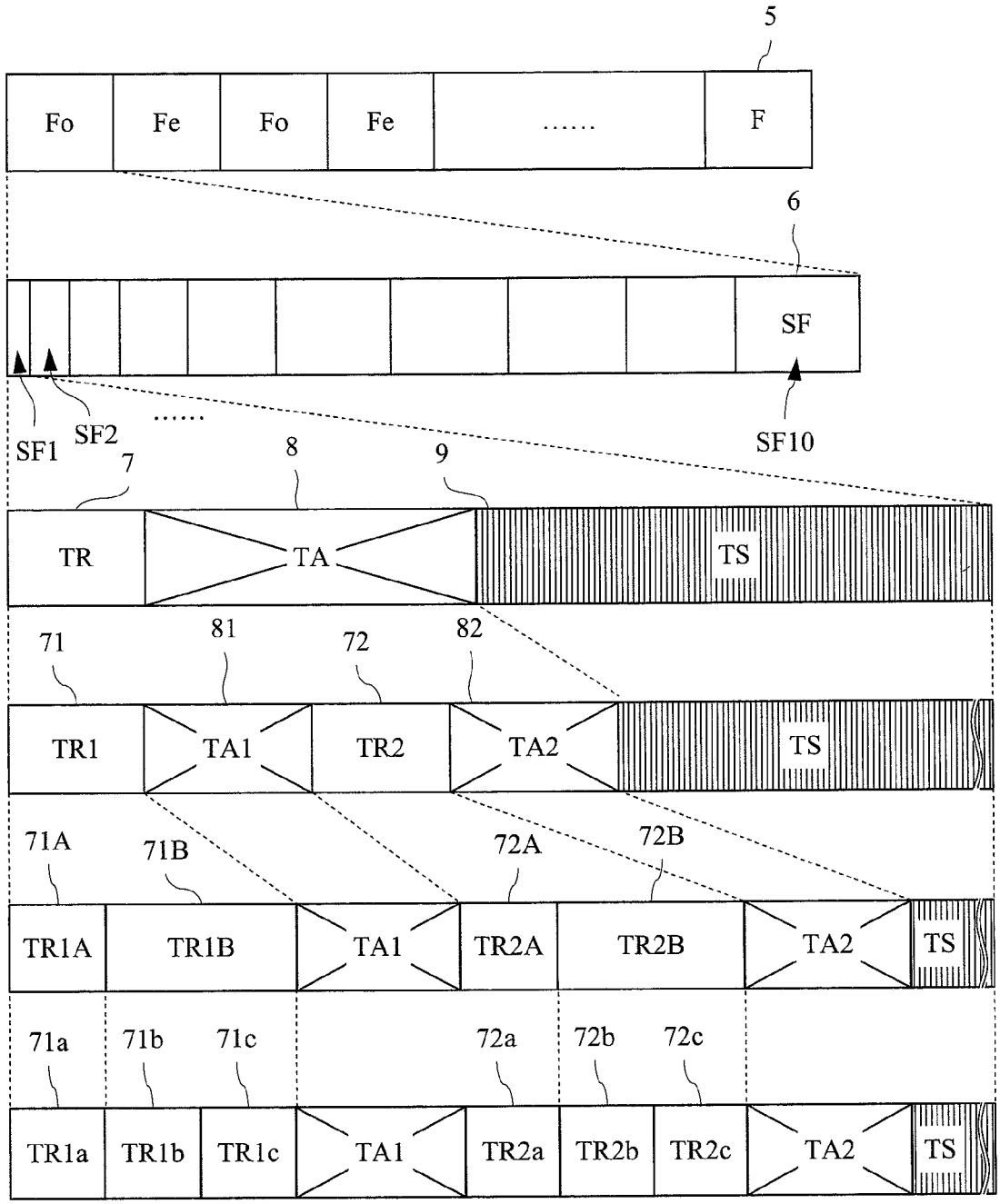
FIG. 6 is a diagram showing an example of a field structure of a PDP in a PDP apparatus according to an embodiment of the present invention.

Hereinafter, embodiments of the present invention will be described in detail with reference to the accompanying drawings. Note that components having the same function are denoted by the same reference symbols throughout the drawings for describing the embodiment, and the repetitive description thereof will be omitted. FIG. 1 shows the outlines of the embodiments and background technologies. FIG. 2 and FIG. 3 show a PDP, FIG. 4 and FIG. 5 show a PDP apparatus, and FIG. 6 shows the structure of fields. FIG. 7 to FIG. 11 show various structural examples of the connection portion between a PDP and a driver in respective embodiments. FIG. 12 to FIG. 24 show characteristics of respective embodiments. Some parts of FIG. 1 and FIG. 25 are used for describing examples of the conventional technologies (background technologies).

<Background Technologies>

First, background structures corresponding to the respective embodiments of the present invention will be briefly described below with reference to FIG. 1. With regard to a PDP and a driving method, the background structures 1 to 6 are PDP apparatuses of the first structure (normal), and the background structures 7 and 8 are PDP apparatuses of the second structure (ALIS and interlace driving method). Further, with regard to arrangement structure of D (X, Y) of a PDP, the background structures 1 to 4 have the sequential repeated arrangement structure of X and Y (XYXY), the background structures 5 and 6 have the reverse repeated arrangement structure of X and Y (XYYX), and the background structures 7 and 8 have the alternate repeated arrangement structure of X and Y (XYXY) since they have the second structure. Further, with regard to A structure, the background structures, 1, 2, 5 and 7 have the single (one side) A structure, and the background structures 3, 4, 6 and 8 have the double (both side) A structure. Also, with regard to sustain driving method in TS (sustain period), the background structures 1 and 3 use the non SSP, and the background structures 2 and 4 to 8 use the SSP. With regard to the number of Y bits (conventional technology), bits equivalent to the number of Ys are required, and k is required in the background technologies 1 to 6 corresponding to the first structure, and k/2 is required in the background technologies 7 and 8 corresponding to the second structure.

Figure 25:
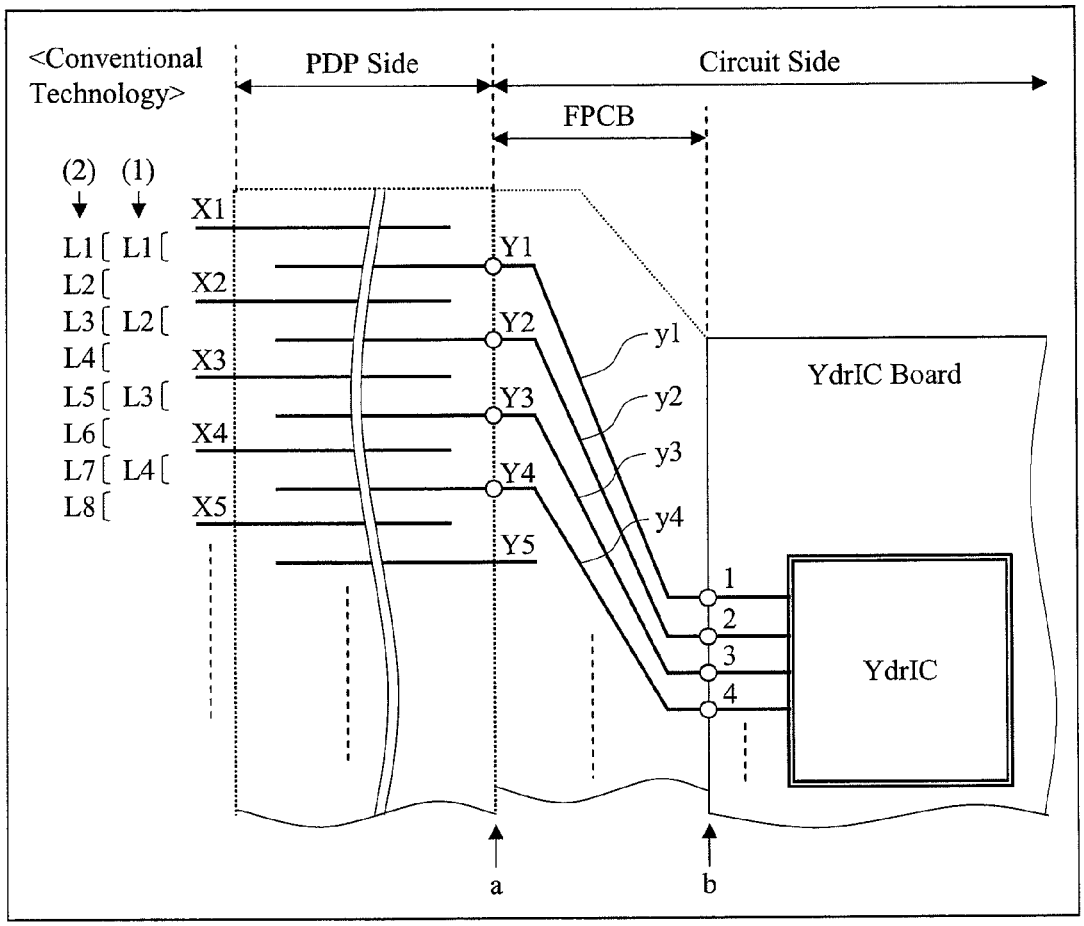
FIG. 25 is a diagram showing a structure example of a connection portion of a PDP side and a circuit side in a PDP apparatus according to the background technologies of the present invention.

FIG. 25 shows a structure example of a connection portion (between PDP and Y driver) in the conventional technology. In this example, end portions (a) of Ys of PDP on the PDP side and output terminal portions (b) of a Y driver (YdrIC board or YdrIC) on the circuit side (in particular, Y driver) are connected by wirings (y) of a FPCB (flexible printed circuit board) as a connection portion (Y connection portion). With regard to the wirings of FPCB, for example, a scan electrode Y1 of a display line L1 is connected to the first output terminal of the Y driver by a wiring y1. In the same manner, Y1 is connected to the i-th output terminal by a wiring yi. In the case of the first structure denoted by (1), Ls (for example, L1 to L4) equivalent to the number of Ls (k) corresponding to the number of Ys (for example, Y1 to Y4) are formed. That is, as the number of Y bits (conventional technology), k is required. In the case of the second structure denoted by (2), Ls (for example, L1 to L8) equivalent to the number of Ls (k) corresponding to twice the number of Ys (for example, Y1 to Y4) are formed. That is, as the number of Y bits (conventional technology), k/2 is required.

<Outlines of Embodiments>

In FIG. 1, in the rows in the table, each "embodiment" corresponds to each "background structure". Respective columns of "Y common connection structure", "voltage waveform", and "number of Y bits (effect)" represent those in the structures according to the respective embodiments. The "Y common connection structure" indicates the structure of common connection for Ys of PDP, wirings and others, and the examples of the mounting structure thereof are shown in FIG. 7 to FIG. 11. The "voltage waveform" corresponds to a pattern of voltage waveforms shown in FIG. 13 and others. The "number of Y bits (effect)" indicates the number of Y bits necessary in the structures of the embodiments by means of the correlation with the number of Ls (k).

As the effect of the respective embodiments, the number of necessary Y bits is only k/2 with respect to k in the case of the first, second and fifth embodiments having the first structure and the single A structure. Also, the number of necessary Y bits is only k/4 in the case of the seventh embodiment having the second structure and the single A structure. Further, particularly in the third, fourth, sixth and eighth embodiments having the double A structure, it can be reduced to half in comparison with that having the single A structure. More specifically, the number of necessary Y bits is only k/2 in the first, second and fifth embodiments, it is only k/4 in the third, fourth, sixth and seventh embodiments, and it is only k/8 in the eighth embodiment.

<PDP>

A structure example of a PDP 101 according to the embodiments will be described with reference to FIG. 2 and FIG. 3. FIG. 2 shows a partially exploded structure corresponding to Cs of the PDP 101. FIG. 3 shows a cross sectional view in the longitudinal direction along A of the PDP 101. The PDP 101 has the above-mentioned second structure, in which barrier ribs are arranged in a stripe shape. Since the structure of a PDP having the first structure (normal) is well-known, the description thereof is omitted, but it may be considered as a structure where L is not formed on a reverse slit side (Y–Xe) obtained by a pair of Y and even-numbered X (Xe) in the second structure shown in this example.

In FIG. 2, the PDP 101 is formed by combining a front substrate 1 and a rear substrate 2 mainly made of glass on which various types of electrodes (X, Y, A) are formed. The front substrate 1 and the rear substrate 2 opposite thereto are adhered to each other, and discharge gas such as Ne, Xe and others is filled into discharge spaces (S) therebetween. By this means, the PDP 101 is formed.

On the front substrate 1, a plurality of Ds (X, Y) extending in the lateral (first) direction are formed approximately in parallel to each other. On the Ds (X, Y) of the front substrate 1, a dielectric layer 21 which insulate them from the discharge spaces (S) is attached, and a protective layer 22 made of, for example, MgO is attached thereon.

In the plurality of Ds, odd-numbered (o) electrodes (including the first and last ones) are sustain electrodes (X), and even-numbered (e) electrodes are scan electrodes (Y). X and Y are used for sustain operation, and Y is used for scan at the address operation. X and Y are adjacently disposed approximately in parallel to each other and are alternately formed in the longitudinal (second) direction at even intervals. X is composed of, for example, a set of an X transparent electrode 11 and an X bus electrode 12. Y is composed of, for example, a set of a Y transparent electrode 13 and a Y bus electrode 14. Electrode composed of a transparent electrode and a bus electrode is represented as a display electrode (D). For each X and Y, transparent electrodes (11, 13) and bus electrodes (12, 14) are electrically connected. The bus electrodes (12, 14) made of metal and having a linear shape are electrically connected to the side of driving circuits (151, 152) via wirings and others. With regard to the types of electrodes, bus electrodes have an electric resistance value lower than that of transparent electrodes. Incidentally, the portion of D (X, Y) present inside the PDP 101 is called an electrode and the portion thereof present outside the PDP 101 on the circuit side is called a wiring. However, it is possible to regard them as an electrode as a whole.

Further, a plurality of address electrodes (A) 25 extending approximately in parallel to each other in the longitudinal direction so as to cross the D (X, Y) are formed on the rear substrate 2. A dielectric layer 24 is attached thereon, and stripe-shaped barrier ribs 23 extending in the longitudinal direction so as to partition the discharge spaces (S) in accordance with the columns of display cells (C) are formed further thereon. The barrier rib 23 is formed also on both sides of the address electrode 25. As a rib structure, not only the barrier ribs 23 extending in the longitudinal direction but also grid-shaped rib structure where barrier ribs extending also in the lateral direction are disposed can be used.

The area partitioned by the barrier ribs 23 where the pair of X and Y and A cross to each other corresponds to a display cell (C). Ls (Lo, Le) are formed of a pair of Y and each of Xs (Xo, Xe) disposed on both sides of the Y in the longitudinal direction.

Phosphors 26 of respective colors of R (red), G (green), B (blue) are separately formed so as to cover the area between the barrier ribs 23, that is, the upper surface of the dielectric layer 24 and side surfaces of the barrier rib 23. A pixel is formed of a set of Cs corresponding to R, G and B. Between adjacent Y and X (slit), particularly by sustain discharge in a discharge gap (g) between the X transparent electrode 11 and the Y transparent electrode 13, phosphors 26 of respective colors are excited and light of respective colors is emitted.

In FIG. 3, portions of D: D1 to D5, L: L1 to L4 are shown as examples. As the Ds, Xs and Ys are alternately disposed at even intervals like {X1, Y1, X2, Y2, X3, . . . } from the top in the longitudinal direction. For example, adjacent Ls: L1 and L2 are formed of D1 to D3 (X1–Y1–X2). As a whole, L1 and L3 correspond to Lo which are odd-numbered Ls and L2 and L4 correspond to Le which are even-numbered Ls. In two adjacent Ls and C, that is, in a set of three Ds, one Y at the center is shared, and Y is commonly used for scan in the address operation for selecting C to be lit. In two adjacent Ls, transparent electrodes (11, 13) are functionally divided by bus electrodes (12, 14). That is, the transparent electrodes (11, 13) are divided into two portions in the width direction.

The width of the X transparent electrode 11 is larger than the width of the X bus electrode 12, and the edge thereof protrudes toward the inside of C. Similarly, the width of the Y transparent electrode 13 is larger than the width of the Y bus electrode 14, and the edge thereof protrudes toward the inside of C. Accordingly, between adjacent X and Y, edges of the X transparent electrode 11 and the Y transparent electrode 13 are opposite to each other, and a discharge gap (g) for sustain discharge and others is formed. The shape of the X and Y transparent electrodes (11, 13) is, for example, a shape having a rectangular or T-shape portion protruding in both upper and lower longitudinal directions from the area of the bus electrodes (12, 14) in accordance with each C. The discharge space (S) extending in the longitudinal direction is shared by each C, and Ls are formed of pairs of all of the adjacent Ds. Since transparent electrodes are formed so as to expand over adjacent Cs on both sides thereof in the longitudinal direction, when voltage is applied to one D, Cs on both sides of the D are influenced.

Further, in the present embodiment, in a plurality of Ds (Y) of the entire PDP 101, a plurality of (in particular, two or four) Ys are commonly connected to form a set unit (Y set unit), and the set unit is connected by corresponding wiring. The wiring corresponding to Y (and Y set unit and Y driver output terminal and others corresponding thereto) is denoted by y. For example, in the first embodiment, Y1 and Y2 are connected to wiring y1 as a Y common connection structure.

<PDP Apparatus and Circuit>

A structure example (corresponding to the first embodiment) of a PDP apparatus in the embodiment will be described with reference to FIG. 4. This PDP apparatus is a PDP module having a PDP 101, a circuit unit, a chassis unit and others. A PDP module is formed by connecting and fixing the PDP 101 (panel portion), the chassis unit and the circuit unit and others. Further, the PDP module is connected and contained in an external chassis or the like, thereby forming a product set of a PDP apparatus.

The PDP 101 has a structure as shown in FIG. 2 and others, and it is a dot matrix panel, a three electrode (X, Y, A) panel, or an AC and surface discharge panel. In FIG. 4, particularly, a structure example having the first structure, the single A structure, and Y common connection structure of type (A) is shown. Meanwhile, in the case of the structure having the second structure, L is formed also on a reverse slit side (example: Y1-X2). In the case of the structure having the double A structure, the area of PDP 101 having the single A structure is divided into an upper area (u) and a lower area (d) and the areas are separately driven in the same manner. In the case of the structure having reverse repeated arrangement structure of X and Y, in the area of PDP 101, Ds are arranged from the top like {(X1, Y1), (Y2, X2), (X3, Y3), . . . }.

In the PDP 101, X and Y form a row (L) in the lateral direction, and a column in the longitudinal direction is formed by A. By n lines of Ys and n lines of Xs, that is, total of 2n lines of Ds, n lines of Ls, in other words, n/2 lines of odd-numbered Ls and n/2 lines of even-numbered Ls (Lo, Le) are formed in only positive slit side (Xi–Yi). The number of Ls (k)=n. n is an even number and $n=2^b$ (b: number of Y bits). Yn and Am form a 2-dimensional matrix of n rows and m columns and correspond to one field 5. It is possible to display a 2-dimensional image by the matrix of Cs. For example, the display cell C (1, 1) corresponds to an intersection between L1 and A1 of (Y1–X1). The display cell C (n, m) corresponds to an intersection between Ln and Am of (Yn–Xn).

The circuit unit of this PDP apparatus includes a control circuit 111 and respective driving circuits (driver: dr) such as an X driving circuit (Xdr) 151, a Y driving circuit (Ydr) 152, and an address driving circuit (Adr) 153. Each circuit is mounted by an IC board and disposed on a rear surface side of the chassis unit. It is also possible to integrally form the control circuit 111 and the respective driving circuits.

Respective drivers {151, 152, 153} are electrically connected to corresponding electrode (X, Y, A) groups of the PDP 101 via connection portions (161, 162, 163) such as a flexible printed circuit board (FPCB) and a module thereof. Drivers and connection portions can be separated according to the number and types of the electrodes.

The output terminal portion of the Xdr 151 is connected to X of the PDP 101, in particular, to the end portion of the X bus electrode 12 by the X connection portion 161. The output terminal portion (white circular mark) of the Ydr 152 is connected to Y of the PDP 101, in particular, to the end portion (white circular mark) of the Y bus electrode 14 by the Y connection portion 162. The output terminal portion of the Adr 153 is connected to the address electrode 25 (A) of the PDP 101 by the A connection portion 163.

The control circuit 111 controls the entire structure including the respective drivers {151, 152, 153}. The control circuit 111 generates respective control signals on the basis of input of signals such as display data, control clock, horizontal sync signal, vertical sync signal and outputs them to the respective drivers. The respective drivers generate and output voltage waveforms for driving the corresponding electrodes of the PDP 101 according to the control signals from the control circuit 111.

The Xdr 151 is a driving circuit which is connected to Ds (Xs) {X1, X2, . . . } and applies voltage for driving Ds (Xs) so as to perform the function of sustain (X). The Xdr 151 applies voltage waveform: VX to X. Internally, the Xdr 151 can be divided into, for example, a circuit for Xo which is an odd-numbered X and a circuit for Xe which is an even-numbered X. In the case where common voltage waveform is applied to a plurality of Xs among all of them, these Xs are commonly connected by wiring of the X connection portion 161 and others, and the same voltage waveform is applied from the Xdr 151 side.

The Ydr 152 is a driving circuit which is connected to Ds (Y) {Y1, Y2, . . . } and applies voltage for driving Ds (Ys) so as to perform the function of sustain and scan (Y). The Ydr 152 applies voltage waveform: VY to Y. Particularly, the Ydr 152 independently applies voltage waveform: Vy to Y set unit, that is, wiring y in accordance with Y common connection structure. A plurality of ys can be driven and controlled individually from the Ydr 152 for applying scan pulse.

As the Y common connection structure, two adjacent Ys of a plurality of Ys are set as a unit and each of the units is commonly connected to the wiring y. For example, Y1 and Y2 are commonly connected to y1 and Yn−1 and Yn are commonly connected to yn/2. More specifically, n/2 wirings y (y1 to yn/2) are connected to the output terminal of the Ydr 152 (the case of the first embodiment). The voltage waveform Vy1 applied to the wiring y1 is applied to Y1 and Y2 commonly connected to the wiring y1 as the same voltage waveforms VY1 and VY2.

The Adr 153 is a driving circuit which is connected to As {A1 to Am} and applies voltage for addressing. The Adr 153 independently applies voltage waveform: VA to As {A1 to Am}, respectively.

A plurality of Xs are divided into odd-numbered Xo (X1, X3, . . . ) and even-numbered Xe (X2, X4, . . . ). A plurality of Ys are divided into odd-numbered Yo (Y1, Y3, . . . ) and even-numbered Ye (Y2, Y4, . . . ).

Note that, in the case of the first structure and the double A structure, the upper area (u) formed in the manner as described above and the lower area (d) formed in the same manner are combined to obtain the structure as follows. That is, 2n lines of Ys and 2n lines of Xs, total of 4n lines of Ds are formed, and total of 2n lines of Ls including n lines of odd-numbered Ls and n lines of even-numbered Ls (Lo, Le) are formed. The number of Ls (k)=2n. The number of ys are n/2 because total 4 lines in the upper and lower areas (u, d) are connected to one y. Also, if h=2n, Y is h, X is h, D is 2h, y is h/4, and C matrix is formed of h rows and m columns.

Another structure example (corresponding to the eighth embodiment) of a PDP apparatus in the embodiment will be described with reference to FIG. 5. FIG. 5 shows the structure having the second structure, the double A structure, and Y common connection structure of type D. The structure in FIG. 5 is different from that of FIG. 4 in PDP electrode structure, driving method, and others.

This PDP apparatus has a PDP 101 having the second structure and the double A structure, a first address driving circuit (first Adr) 153A, and a second address driving circuit (second Adr) 153B as Adr of the circuit unit. The first and second Adr (153A, 153B) are driving circuits which apply voltage for addressing to address electrodes 25 (A1 to Am) Respective Adr (153A, 153B) are electrically connected to corresponding As (Au, Ad) of the PDP 101 via connection portions (163A, 163B) such as wirings of an FPCB. The output terminal portion of the first Adr 153A is connected to Au (Aul to Aum) of the upper area (u) of the PDP 101 by the A connection portion 163A and the output terminal portion of the second Adr 153B is connected to Ad (Adl to Adm) of the lower area (d) of the PDP 101 by the A connection portion 163B, and they can be independently driven by the application of voltage waveforms (VAu, VAd).

In the upper area (u) of the PDP 101, with respect to the arrangement of a plurality of Ds (X, Y), Xs are arranged at odd-numbered (o) positions (including the first and last positions), and Ys are arranged at even-numbered (e) positions. By n lines of Ys and (n+1) lines of Xs, that is, total of (2n+1) lines of Ds, total of 2n lines of Ls including n lines of odd-numbered Ls and n lines of even-numbered Ls (Lo, Le) are formed. If the lower area (d) structured in the same manner as the upper area (u) is combined, by 2n lines of Ys and (2n+1) lines of Xs, that is, total of (4n+1) lines of Ds, total of 4n lines of Ls including 2n lines of odd-numbered Ls and 2n lines of even-numbered Ls (Lo, Le) are formed. The number of Ls (k)=4n. Note that it is assumed that Xn+1 at the boundary is shaped by (u, d).

A plurality of Xs are divided into Xo and Xe. A plurality of Ys are divided into Yo and Ye. A plurality of Ys are divided into Yu corresponding to the upper area (u) and Au and Yd corresponding to the lower area (d) and Ad.

As the Y common connection structure, in FIG. 5, two lines of every other line in the upper area (u) and two lines of every other line in the lower area (d), that is, total of four lines of Y in (u, d) are set as a unit, and each of the units is commonly connected to the wiring y. A plurality of ys can be individually driven and controlled from the Ydr 152. For example, Ys (Y1, Y3, Yn+1, Yn+3) are connected to Y1, and Ys (Y2, Y4, Yn+2, Yn+4) are connected to Y2 (the case of the eighth embodiment). More specifically, n/2 wirings y (y1 to yn/2) are connected to the output terminal of the Ydr 152.

In the PDP 101, by all the pairs of adjacent Ds, that is, by the slits (positive/negative slits) at both the upper and lower sides in the longitudinal direction of each Y, lines (L) in the lateral direction are formed. As a whole, a two-dimensional matrix of 4n rows and m columns is formed in (u, d) n lines of Yu and Yd are provided (n is an even number), and $n=2^b$ (b: number of Y bits). By 2*n* lines of Ys and 2n+1 lines of Xs, that is, total of 4n+1 lines of Ds, total of 4n lines of Ls including 2n lines of odd-numbered L and 2*n* lines of even-numbered Ls (Lo, Le) are formed. The number of Ls (k)=4n. Further, if h=2n, Y is h, X is h+1, D is 2h+1, y is h/4, and C matrix is formed of 2h rows and m columns.

The Ydr 152 independently applies voltage waveform: Vy to the wiring y of Y set unit in (u, d) in accordance with the Y common connection structure. For example, the voltage waveform Vy1 applied to the wiring y1 is applied to (Y1, Y3, Yn+1, Yn+3) commonly connected to the wiring y1 as the same voltage waveform (VY1, VY3, VYn+1, VYn+3).

<Field>

A field 5 structure in this embodiment will be described with reference to FIG. 6. Note that these detailed structures can be variously modified according to driving methods, and the division in TR7 and TA8 shown in this example are just an example.

One field (denoted by F and also referred to as frame) 5 corresponding to the screen of the PDP 101 includes a plurality of subfields (denoted by SF) 6 such as 10 SFs 6 from "SF1" to "SF10". The field 5 is expressed by, for example, 60 fields/second. In the SF 6, weighting concerning sustain period (TS) 9 is different, and the grayscale is expressed by combining the SFs 6 to be lit in the field 5.

In the driving method of the PDP 101, as a unit of time for display, the field 5 and SF 6 are controlled. In particular, in the case using the interlace driving method, odd-numbered fields (Fo) and even-numbered field (Fe) in a plurality of fields 5 are alternately driven and displayed by different voltage waveforms.

Each SF 6 has a reset period (TR) 7, an address period (TA) 8, and a sustain period (TS) 9. TR 7 is the period corresponding to a reset operation for the initialization (averaging wall charge) and the preparation of addressing. TA 8 is the period corresponding to the addressing (address operation) where discharge to select C (lighting C) to be lit (emit light) is generated to make the C into a state where discharge can be generated (or cannot be generated) in TS 9. Specifically, in the address operation, scan pulse is sequentially applied to a plurality of Ys and address pulse is applied to As in response to that. By this means, the potential of X is made to be a dischargeable potential with the Y, and then, discharge is generated between X and Y with using the discharge between A and Y as a trigger. In this manner, lighting (ON)/non-lighting (OFF) of a desired C can be selected. TS 9 is the period corresponding to the sustain operation where discharge (sustain discharge) for display is generated between X and Y of only C selected to be lit by the addressing. Each SF 6 is different in the number of times of lighting (length of TS 9) by the sustain pulse to be applied to X and Y in TS 9.

Further, in the case using the driving control by two-stage reset and address operation, TR7 and TA 8 in SF 6 are divided into a first period (former half) and a second half (latter half). That is, TR 7 and TA 8 are composed of a first reset period (TR1) 71, a first address period (TA1) 81, a second reset period (TR2) 72, and a second address period (TA2) 82.

Furthermore, TR 7 is functionally divided into a plurality of periods. For example, it is divided into a first period (A) for address disable operation and a second period (B) for main reset discharge. That is, the first reset period (TR1) is divided into a first period (TR1A) 71A and a second period (TR1B) 71B, and in the same manner, the second reset period (TR2) 72 is divided into a first period (TR2A) 72A and a second period (TR2B) 72B.

Moreover, TR 7 is divided into, for example, first to third periods. The second period (TR1B) 71B and the second period (TR2B) 72B for the reset discharge are divided into a former half (b) and a latter half (c). That is, the first reset period (TR1) 71 is divided into a first period (TR1*a*) 71*a* for address disable operation (similar to 71A), a former half second period (TR1*b*) 71*b*, and a latter half third period (TR1*c*) 71*c*. Similarly, the second reset period (TR2) 72 is divided into a first period (TR2*a*) 72*a* (similar to 72A), a second period (TR2*b*) 72*b*, and a third period (TR2*c*) 72*c*.

The respective first periods (71A, 72A, 71*a*, 72*a*) are the periods in which waveform corresponding to the address disable operation described later is applied in the driving control using a plurality of Ls (or slits) as a control unit. The respective second periods (TR1B, TR2B) are the periods in which waveform corresponding to main reset discharge (and non reset discharge) operation is applied in accordance with the address disable operation at the former stage. The respective second periods (TR1*b*, TR2*b*) are the periods forming a part of the reset operation, in which waveform corresponding to charge accumulation (write) operation is applied. The respective third periods (TR1*c*, TR2*c*) are the periods forming a part of the reset operation, in which waveform corresponding to charge adjustment operation is applied.

Note that, as the address method for display, there are a write address method and a delete address method. In the write address method, such an address operation is performed that, in TR 7, all Cs are made into a state where discharge cannot be generated in TS 9, and in TA 8, C to be lit is made into a state where discharge can be generated in TS 9, and then, it shifts to TS 9. In the delete address method, such an address operation is performed that, in TR 7, all Cs are made into a state where discharge can be generated in TS 9, and in TA 8, C not to be lit is made into a state where discharge cannot be generated in TS 9, and then, it shifts to TS 9. In the present embodiment, the write address method is used.

Incidentally, as a function of D, Y applies scan pulse at the time of the address operation of the TA 72 (used in address selection), and X does not apply scan pulse at the time of the address operation of the TA 72.

First Embodiment

Figure 10:
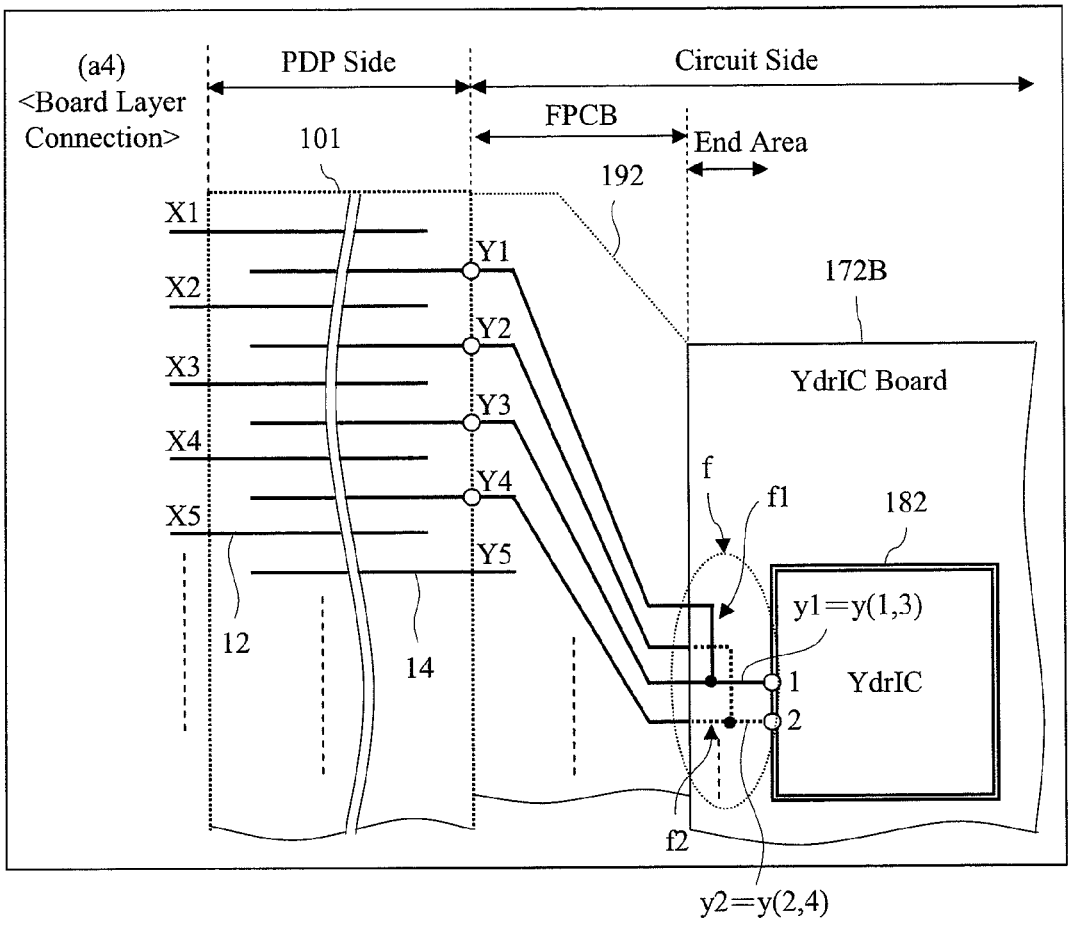
FIG. 10 is a diagram showing a structure example (a4) of a connection portion of a PDP side and a circuit side, in a PDP apparatuses according to respective embodiments of the present invention.
Figure 11:
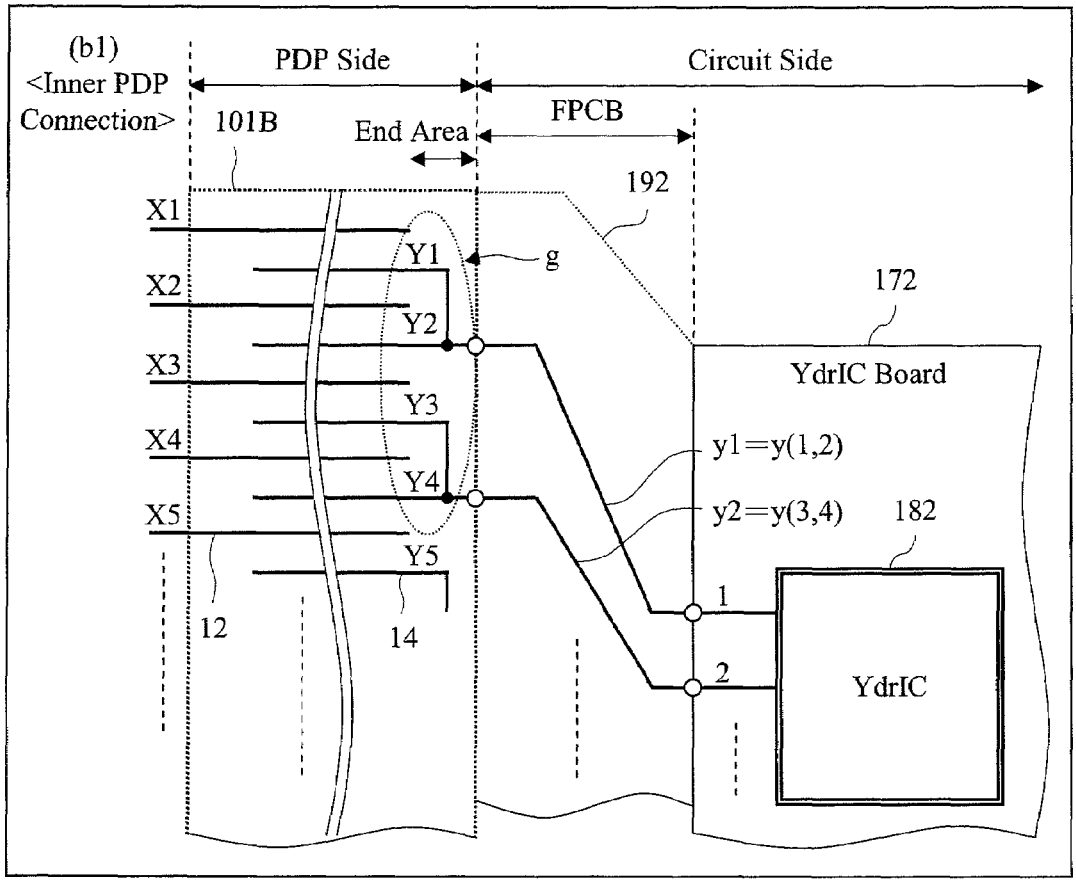
FIG. 11 is a diagram showing a structure example (b1) of a connection portion of a PDP side and a circuit side, in a PDP apparatus according to respective embodiments of the present invention.
Figure 12:
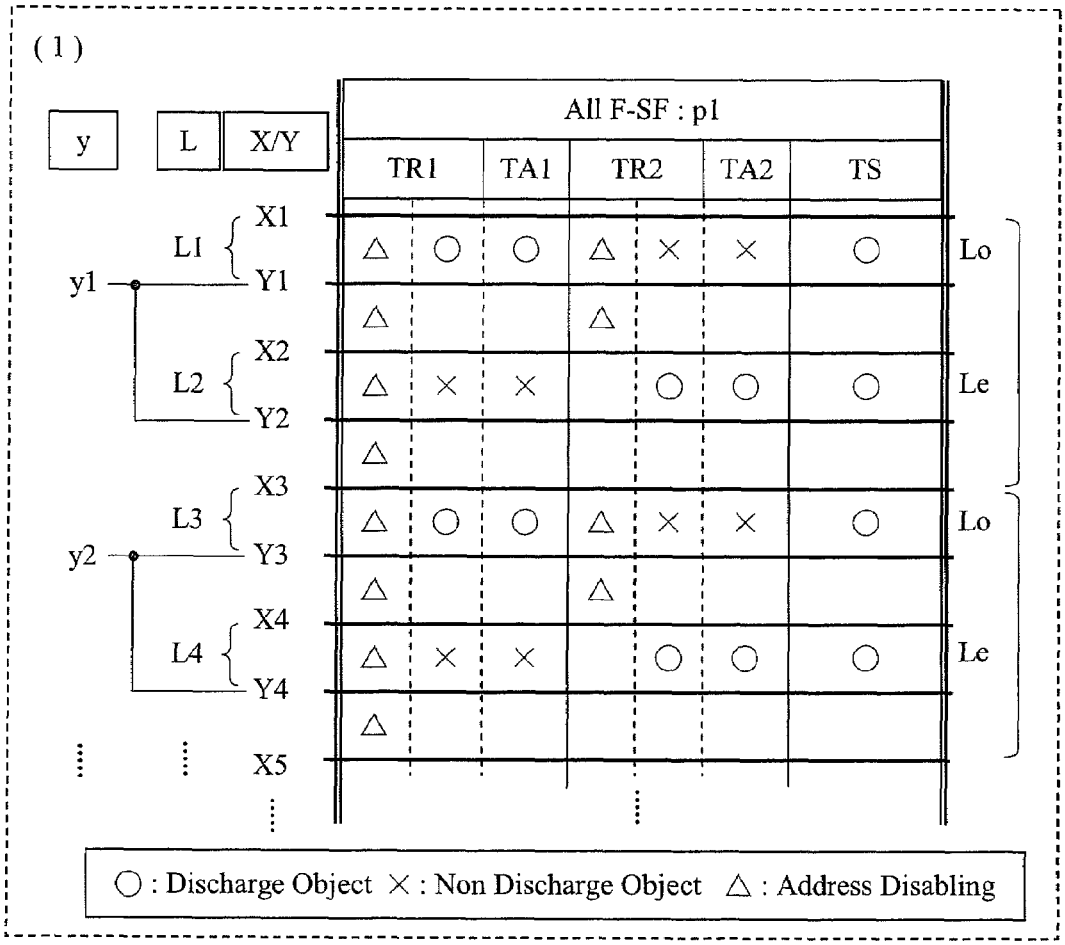
FIG. 12 is a diagram showing control objects and timings in a driving method of a PDP apparatus according to the first embodiment of the present invention.
Figure 13:
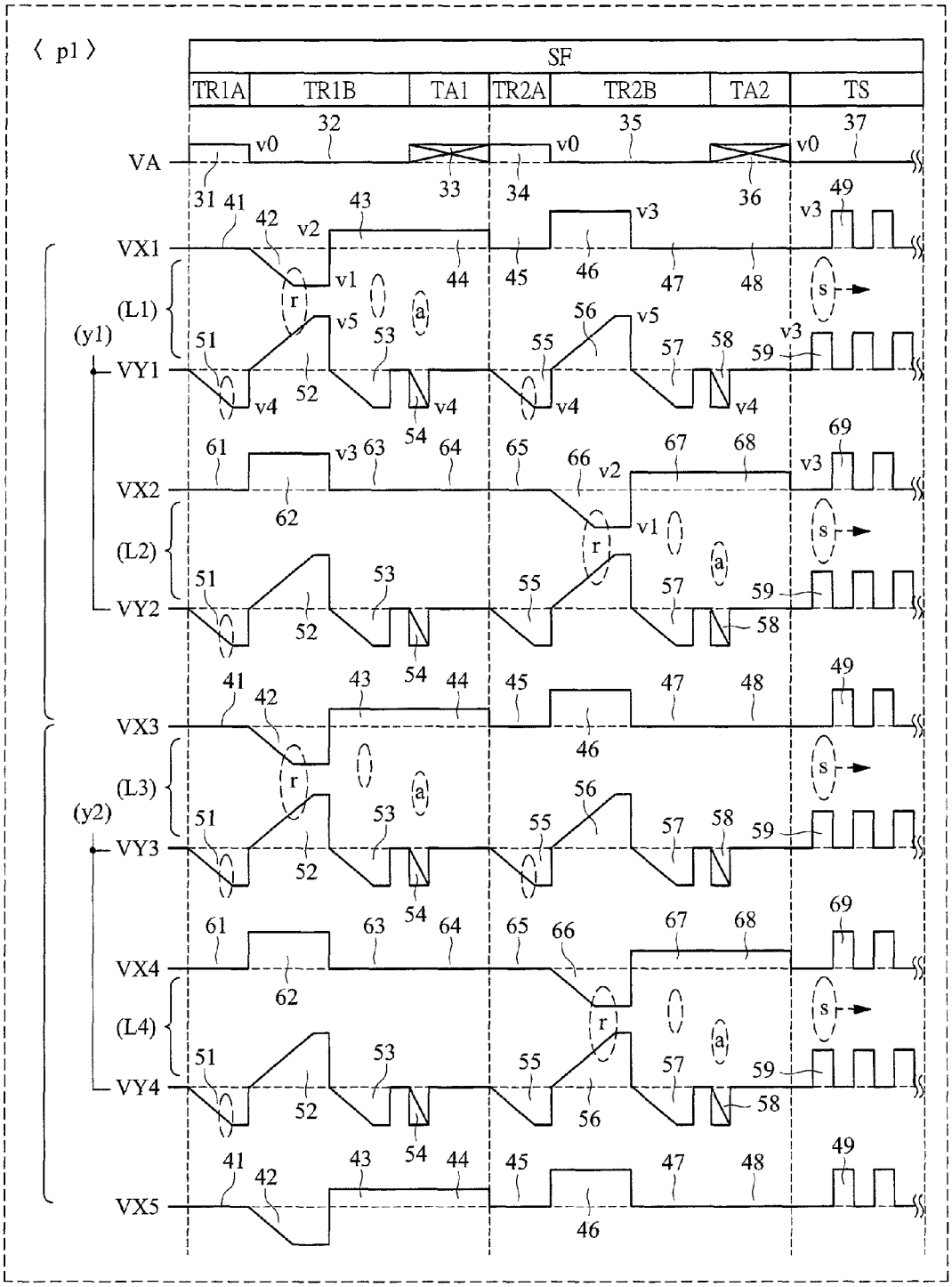
FIG. 13 is a diagram showing the structure of pattern (p1) of voltage waveforms in the driving method of a PDP apparatus according to the first embodiment of the present invention.

The first embodiment of the present invention will be described with reference to FIG. 7 to FIG. 11, FIG. 12, FIG. 13 and others. FIG. 7 to FIG. 11 show structure examples around a Y connection portion 162 applicable in the first embodiment. As an outline of driving control in the first embodiment, FIG. 12 shows objects to be controlled (drive display and objects to be discharged) and timing in a characteristic driving method in the first embodiment. FIG. 13 shows a pattern (p1) of voltage waveforms used in the driving control in the first embodiment corresponding to FIG. 12.

In the structure of the first embodiment, on the basis of the background structure 1, as the first Y common connection structure (type: A), two adjacent Ys (Y1, Y2) in all Ds of the PDP 101 form a set unit, and each of the set unit is connected by wiring y (corresponding to FIG. 4 and (a1) in FIG. 7, (a2) in FIG. 8, (b1) in FIG. 11 and others). Also, as a voltage waveform of the driving corresponding to such a Y common connection structure, for example, the pattern (p1) shown in FIG. 13 is applied from Ydr 152 to y (Y).

<Structure Example of Connection Portion>

Figure 7:
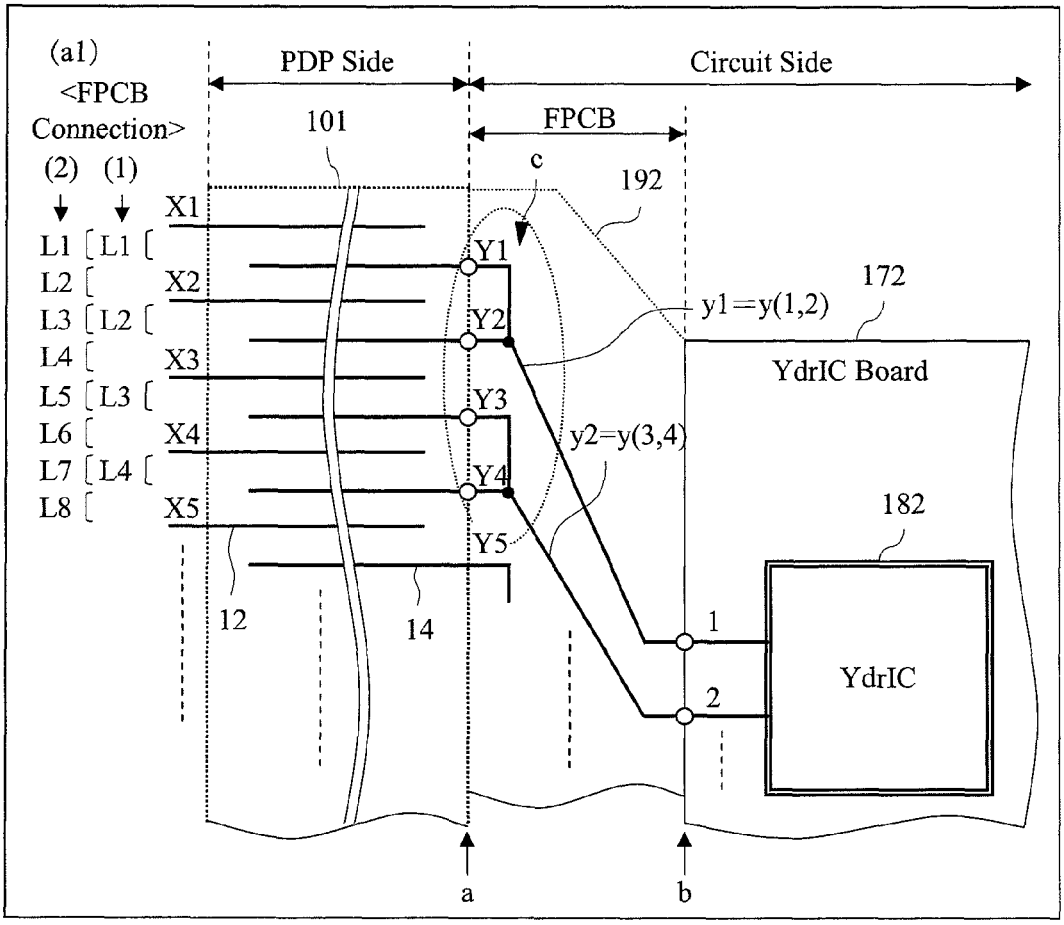
FIG. 7 is a diagram showing a structure example (a1) of a connection portion of a PDP side and a circuit side, in a PDP apparatus according to respective embodiments of the present invention.
Figure 8:
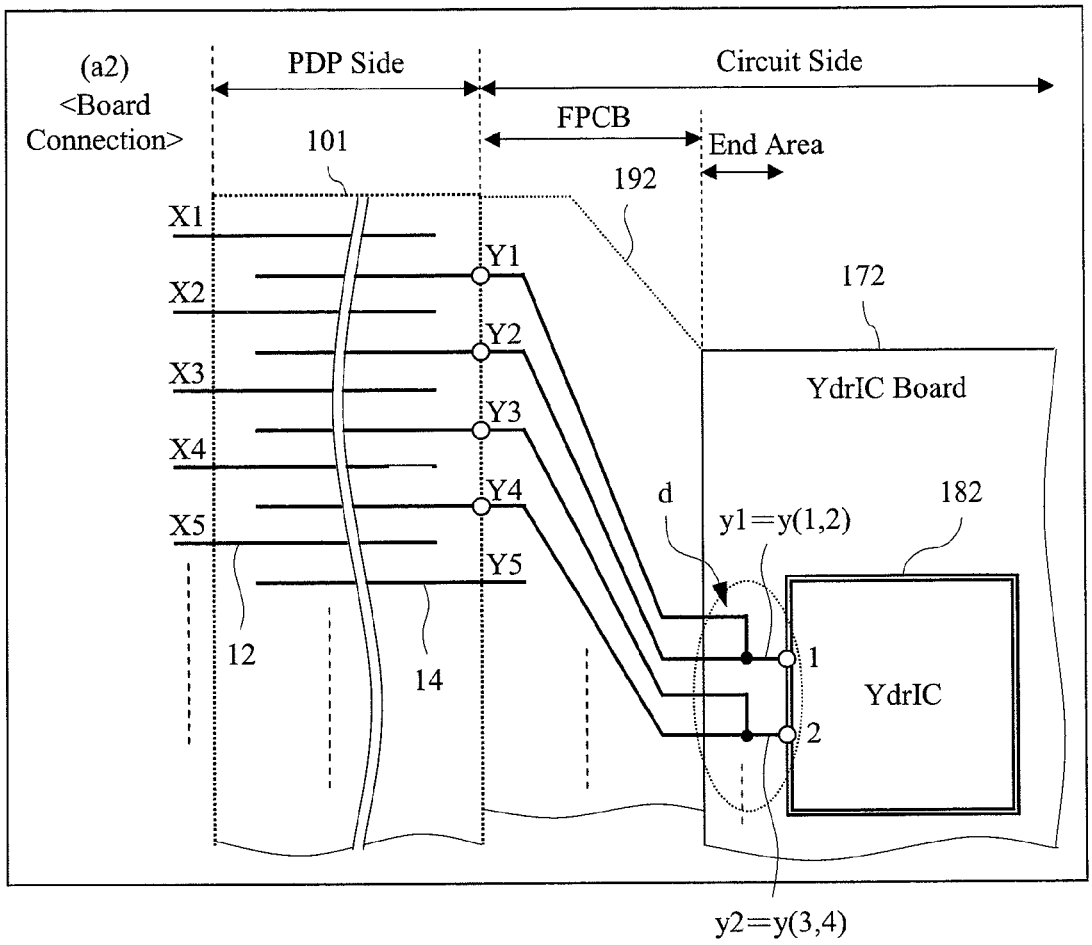
FIG. 8 is a diagram showing a structure example (a2) of a connection portion of a PDP side and a circuit side, in a PDP apparatus according to respective embodiments of the present invention.
Figure 9:
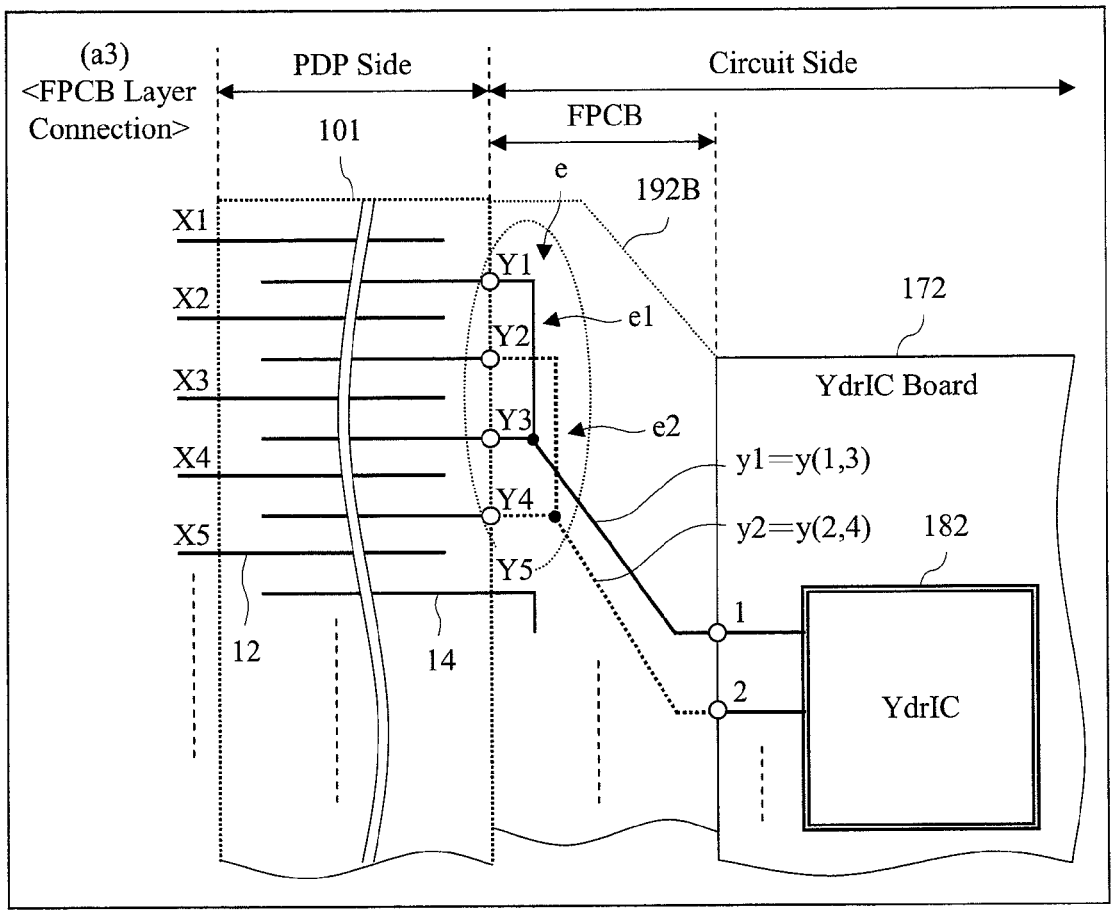
FIG. 9 is a diagram showing a structure example (a3) of a connection portion of a PDP side and a circuit side, in a PDP apparatus according to respective embodiments of the present invention.

Structure examples of the Y connection portion 162 in the first embodiment and others will be described with reference to FIG. 7 to FIG. 11. FIG. 7 to FIG. 10 show the embodiments (a1 to a4) where the Y common connection is made on the circuit side (outside the PDP 101). FIG. 11 shows the embodiment (b1) where the Y common connection is made on the PDP 101 side (inside the PDP 101). Further, FIG. 7 and FIG. 9 show the embodiments (a1, a3) where the Y common connection is made by FPCB. FIG. 8 and FIG. 10 show the embodiments (a2, a4) where the Y common connection is made by YdrIC board. Furthermore, FIG. 7, FIG. 8, and FIG. 11 show the examples where two adjacent Ys are connected by wiring y. FIG. 9 and FIG. 10 show the examples where two Ys of every other Y are connected by wiring y. In the first, third, fifth, and sixth embodiments, for example, structures of (a1) to (a4) and (b1) can be applied. In the second, fourth, seventh, and eighth embodiments, for example, structures of (a1) to (a4) can be applied.

First, in the structure example (a1) shown in FIG. 7, portions of X bus electrodes 12 and Y bus electrodes 14 on the PDP 101 side such as X1 to X5 and Y1 to Y4 are shown. In the case of the first structure denoted by (1), Ls such as L1 to L4 are formed only on the positive slit (Xi−Yi) side. In the case of the second structure denoted by (2), Ls such as L1 to L8 are formed on both the positive and reverse slits (Xi−Yi, Yi−Xi+1).

On the circuit side (including connection portion) to be connected to the PDP 101, the Y connection portion 162 is composed of an FPCB 192 or a module thereof. Further, the Ydr 152 is disposed as YdrIC board 172 on which YdrIC 182 is mounted. The end portion of PDP 101 and Y or output terminal portion (a) thereof and the end portion of YdrIC board 172 and YdrIC 182 or the output terminal portion (b) thereof are connected to corresponding end portion of the FPCB 192.

On the PDP 101 side, end portions (white circular mark) of respective Ys (example: Y1 to Y4) are connected to the respective wirings y portions (corresponding to y1 to y4 in FIG. 25) on the FPCB 192. In these wirings y from the PDP 101 side, as shown by c, two adjacent Ys (Y1 and Y2, Y3 and Y4) are commonly connected on the FPCB 192. More specifically, in the wirings y from the PDP 101 side, two adjacent Ys form a set, and each of the sets is electrically connected to the wirings y (example: y1, y2) on the YdrIC board 172 side and further connected to the output terminals (white circular mark) (example: 1, 2) of the YdrIC board 172. In FIG. 7, for example, they are represented as wiring y1=y(1, 2) and wiring y2=y(3,4) (numbers in parentheses of y represent relation of electrodes and wirings before common connection).

Next, in the structure example (a2) shown in FIG. 8, in the end portion area on the YdrIC board 172 side, in other words, in the area between an end portion of the YdrIC board 172 and an output terminal of the YdrIC 182, two adjacent wirings y are commonly connected. The respective wirings y (similar to y1 to y4 in FIG. 25) on the FPCB 192 are commonly connected as shown in d in accordance with the two adjacent Ys in the end portion of the YdrIC board 172, that is, they are electrically connected to wirings y (example: y1, y2) to the output terminals of the YdrIC 182.

Next, in the structure example (a3) shown in FIG. 9, the Y connection portion 162 is formed of a two-layered (or multilayered) FPCB 192B. The Y common connection is made by use of two layers in the FPCB 192B in the same manner as that of the above-described (a1). More specifically, as shown in e, ends of the Ys on the FPCB 192B are connected by the wiring of a front surface (or the first layer) e1 of the FPCB 192B and the wiring of a rear surface (or the second layer) e2. The case where two Ys of every other Y are connected is shown here. For example, Y1 and Y3 are connected by the wiring y1 of e1 (y1=y(1, 3)), and Y2 and Y4 are connected by the wiring y2 of e2 (y2=y(2, 4)).

Next, in the structure example (a4) shown in FIG. 10, the Ydr 152 is formed of a YdrIC board 172B with a multilayered wiring structure. The Y common connection is made by use of multiple layers (two layers) in the YdrIC board 172B in the same manner as that of the above-described (a2). That is, as shown in f, the wirings y from the FPCB 192 side (similar to y1 to y4 in FIG. 25) and the output terminals of the YdrIC 182 are connected by use of the wiring of the first layer f1 and the wiring of the second layer f2 in an end portion area of the YdrIC board 172B. For example, Y1 and Y3 are connected by the wiring y1 of f1 (y1=y(1, 3)), and Y2 and Y4 are connected by the wiring y2 of f2 (y2=y(2, 4)).

Next, in the structure example (b1) shown in FIG. 11, Ys (Y bus electrodes 14) are commonly connected on the PDP 101 side, that is, in the end portion area of the PDP 101. As shown in g, two adjacent Ys (for example, Y1 and Y2) are electrically connected in the end portion area in the PDP 101. Also, these commonly connected Ys extend to the end portions (white circular mark) of the PDP 101 and are further connected to the end portion of the FPCB 192. In the connection on the FPCB 192 and the YdrIC board 172 side, the number of wirings y (example: y1, y2) is reduced to half the number of Ys.

As described above, according to the respective structures (a1) to (a4) and (b1), in the case of the first structure, two adjacent Ls are commonly connected, and, in the case of the second structure, adjacent four Ls are commonly connected. Accordingly, in both the first and second structures, the number of Y bits is reduced to ½ of that of the conventional technology.

<Driving Control (1)>

The outline of driving control of the first embodiment will be described with reference to FIG. 12. FIG. 12 schematically shows the correlation of the control in each period and D, L, y in the driving control of SF 6. For example, as a partial control unit of the entire PDP 101 area, D: D1 to D9: (X1, Y1, . . . , Y4, X5), L: L1 to L4, y: y1 and y2 are shown. In the first embodiment, for a specified unit of time for display, that is, for all SFs 6 in all fields 5, driving control is similarly made by the application of the pattern (p1) of voltage waveforms.

In the first embodiment, in the PDP (normal) of the background structure 1, for example, Ls are arranged like L1 (X1, Y1), L2 (X2, Y2), . . . , and only (Xi−Yi) side becomes an object of drive display (positive side) and L is not formed on (Yi−Xi+1) side and it does not become an object of drive display (reverse side) (shown by blank). In TS 9, sustain pulse is repeatedly applied so that Xs (X1, X2, . . . ) have the same phase and Ys (Y1, Y2, . . . ) have the same phase (non SSP).

Note that the object of the drive display (positive side) indicates the one in which address selection is possible in TA 8 and address selected C can be lit by sustain discharge in TS 9. When a certain L is an object of drive display (address selection possible), lighting ON/OFF of a plurality of Cs of the L can be controlled.

As the Y common connection structure, two adjacent Ys, for example, Y1 and Y2 are connected by y1 (y1: (Y1, Y2)) and Y3 and Y4 are connected by y2 (y2: (Y3, Y4)). For example, a voltage waveform to (Y1, Y2) is defined as (VY1, VY2). When voltage waveform Vy1 is applied to the wiring y1 form the Ydr 152 side, the same voltage waveforms (VY1, VY2) are applied to (Y1, Y2).

When viewed as control units corresponding to the wirings y and a plurality of Ls, one wiring y (example: y1) is connected to two adjacent Ls (example: L1, L2), thereby forming one control unit. For example, a control unit corresponding to one wiring is formed by adjacent L1 and L2 (four lines from X1 to Y2 or five lines from X1 to X3). Voltage waveforms of the same pattern are applied to respective control units.

As described above, SF 6 includes such periods as TR1, TA1, TR2, TA2, and TS in accordance with the two-stage reset and address operation control including an address disable operation. In details, TR1 and TR2 are composed of the first period (a), the second period (b), and the third period (c) as mentioned previously. TR1 (TR2) is a preparation period for correctly operating the address discharge in the next TA1 (TA2) In the columns of respective Ds partitioned by each of the periods, the circular mark (O) represents an object to generate a certain kind of discharge corresponding to respective periods. On the contrary to the circular mark, the cross mark (X) represents an object not to generate discharge. The triangle mark (Δ) represents an object of address disable operation to be a part of reset and address operation or a former stage operation thereof (indicating the operation in the Ls on both sides of Y). The blank represents non-object of drive display (non L or reverse side), and various discharges such as reset, address, sustain and others are not generated.

Broadly speaking, in the driving control of SF 6, pulse for reset discharge (charge accumulation pulse and charge adjustment pulse) is applied to each L in TR7, and reset discharge is generated in the discharge gap (g) of the D pair (slit). Next, in TA8, scan pulse is applied to each Y {Y1, Y2, . . . } while delaying the timing thereof, and address pulse is applied to A at the corresponding timing, thereby generating the address discharge between A and Y and between the corresponding X and Y. In TS9, sustain pulse is applied to each L and sustain discharge is generated in the discharge gap (g) between X and Y, and C to be lit emits light.

In the drive display of the control unit, by use of the address disable operation, reset and address operations of the different Ls (example: L1, L2) are performed in two-stage periods of former and latter periods, and the sustain discharge for both the Ls (L1, L2) is simultaneously performed in next TS9. In the first embodiment, operations of the odd-numbered L and even-numbered L (Lo, Le) corresponding to two Ys (Yo, Ye) commonly connected to wiring y are separately performed in former and latter periods, respectively. For example, reset and address operation of the Lo (L1, L3) is performed in the first stage (former half) and reset and address operation of the Le (L2, L4) is performed in the second stage (latter half) (that is, reset and address discharges are generated). Addressing is separately performed in the former and latter periods so that addressing on the Lo side is performed in TA1 and that on the Le side is performed in TA2.

In TR1, in the address disable operation of TR1A (TR1*a*), pulse for address disable operation is applied to y (y1, y2, . . . ) and corresponding A. By this means, both Ls (Lo, Le) corresponding to two Ys for the y (Y set unit) and positive and reverse slits on both sides of the Y are put into a charge state where address discharge is impossible (address disable state). More specifically, they are put into a charge state where address discharge is not generated unless reset discharge is generated thereafter.

In the next TR1B, reset discharge by charge write in TR1*b* and charge adjustment in TR1*c* is generated to only L (example: Lo) of one Y in the y. By this means, the L (Lo) is put into a state where address discharge can be generated. In this TR1B, operation is not performed (reset discharge is not generated) in L (example: Le) of the other Y in the y, and it is left in the address disable state.

In the next TA1, address discharge is generated in only the L (Lo) of the Y on one side which is put into a charge state where address discharge can be generated by the reset discharge of the former stage. Scan pulse is applied to respective ys (Yo) sequentially from the top, and then address pulse is applied to A. In this manner, the address operation is performed only on the Lo side.

Also in TR2A, TR2B and TA2 in the latter half, by use of the reset operation including address disable operation in the same manner, addressing is performed by generating address discharge in only L (Le) of the other Y in the y on the contrary to the former half. The sequence where Lo and Le of TR1 are reversed is performed in TR2. By this sequence, addressing of all the Ls (Lo, Le) in the plurality of control units is completed.

Finally in TS, sustain discharge is generated in Ls (Lo, Le) of both of the Ys in each y. At the same time with the operation on the positive side in these TR7, TA8 and TS9, the reverse side (example: Y1-X2, Y2-X3) is controlled so as not to perform such operations as reset, address and sustain by respective pulses including address disable operation by the adjacent respective voltage waveforms, that is, so as not to generate various kinds discharges. Alternatively, in the pairs of Ds on the reverse side, discharge is suppressed to a degree lower than that generated in the pairs of Ds on the positive side.

The voltage waveforms to be applied to respective Ys for the driving control are the same in two adjacent Ls (Lo, Le), that is, in two adjacent Ys (Yo and Ye). Accordingly, in the structure where they are commonly connected to wiring y (example: y1) as described previously, they are driven by the application of the same voltage waveform Vy (example: Vy1).

Note that, with regard to the order of the reset and address operation to two Ls (Lo, Le) in the control unit corresponding to wiring y, any order is applicable, that is, the order in which the operation to Le is first and that to Lo is second is also possible. In this embodiment, the operation to Lo is first and that to Le is second. Further, with regard to respective address disable operations in TR7 (TR1A, TR2A) of the former half and the latter half of two stages, not only the structure where they are performed in both the former half and the latter half but also the structure where they are omitted in the former half and performed in only the latter half are possible.

Further, with respect to a plurality of Xs, the same voltage waveform (VXo) is applied to each of the Xo and the same voltage waveform (VXe) is applied to each of the Xe, respectively. The voltage waveforms (VXo, VXe) are those obtained by reversing the former and latter of the pulses to be applied in the first and second periods of the two-stage reset and address operation.

<Voltage Waveform (1)>

The outline of voltage waveforms in the first embodiment will be described with reference to FIG. 13. The voltage waveforms include voltage waveforms: VX (VXo, VXe) to be applied from Xdr 151 to X (Xo, Xe), voltage waveforms: VY (VYo, VYe) to be applied from Ydr 152 to Y (Yo, Ye), that is, voltage waveforms: Vy {Vy1, Vy2, . . . } to be applied to wiring ys of Y set units, and a voltage waveform: VA to be applied from Adr 153 to A (A1 to Am). As examples, there are VX {VX1 to VX5} and VY {VY1 to VY4} (corresponding to Vy1, Vy2) corresponding to D (X1, Y1, . . . , Y4, X5) and (y1, y2). With regard to reference characters in areas of dotted line circles, r represents occurrence of reset discharge, a represents occurrence of address discharge, and s represents occurrence of sustain discharge. The areas of dotted line circles corresponding to TR1A and TR2A in VYs represent discharge between A and Y in the address disable operation.

As the two-stage reset and address operation control in control unit, the same voltage waveform is applied to adjacent Yo and Ye as Vy. Also, the same voltage waveform is applied to Xo and Xe, respectively. In TR1, address disable operation in Ls of both Ys in y and positive and reverse slits and reset discharge (r) of Lo of Yo of one side are performed, and in TA1, address discharge (a) in the same Lo is performed. In TR2, address disable operation in Ls of both Ys in y and positive and reverse slits and reset discharge (r) of Le of Ye of the other side are performed, and in TA2, address discharge (a) in the same Le is performed. Thereafter, in TS, Ls (Lo, Le) on both sides are simultaneously displayed by display discharge (s).

The following is the description about driving control of control unit corresponding to y. First, in TR1A, as shown in VA and VY (Vy), a rectangular wave pulse 31 is applied to A, and negative trapezoidal wave pulse 51 is applied to two adjacent Ys of y. VX is kept at reference potential (0V). By this means, discharge (discharge for address disable) is generated from A to Y, and wall charge is formed on Y. In this manner, all Ls between Xo and Yo (Lo) and between Xe and Ye (Le) and reverse slits thereof are put into a charge state where discharge (a) for address does not occur in next TA8 unless discharge (r) for initialization (reset) is generated. Such an operation is defined as "address disabling".

Next, in TR1B, discharge (r) is generated between Xo and Yo (Lo), and only Lo is initialized (reset) and the Lo is put into a state where the addressing can be performed. Next, in TA1, discharge (a) is generated between Xo and Yo (Lo) and the addressing of Lo is performed.

Next, similar to TR1A, in TR2A, discharge is generated from A to two adjacent Ys of y, and wall charge is formed on Ys. By this means, all Ls of Xo and Yo (Lo) and Xe and Ye (Le) and reverse slits thereof are put into an address disable state. Next, in TR2B, discharge (r) is generated between Xe and Ye (Le), and only Le is initialized and the Le is put into a state where the addressing can be performed. Then, in TA2, discharge (a) is generated between Xe and Ye (Le) and the addressing of Le is performed.

Also, in the sustain operation in TS9, first, voltage (sustain pulse) is applied from each Y to upper X to generate display discharge (s) in Cs to be lit of Yo and Xo (Lo) and Ye and Xe (Le), and then, voltage (sustain pulse) is applied from the X to Y in a reverse direction to generate display discharge (s) in Cs of the Ls concerned in the same manner. Thereafter, they are repeated in the same manner. By this means, all the Ls (Lo, Le) are simultaneously driven and displayed.

In this case, in TR2A described above, the following conditions are to be satisfied. As the condition 1, the charge of C (C to be lit) by the address discharge (a) in the former half (TA1) should not be deleted but be maintained as it is so that it can be used in the subsequent display discharge (s). As the condition 2, C (C not to be lit) to which the address discharge (a) is not generated in the former half (TA1) should be put into a charge state where discharge does not occur in the latter half (TA2). As the condition 3, charge enough to generate discharge at the time of the display discharge (s) should not be accumulated in C (C not to be lit) to which the address discharge (a) is not generated in the former half (TA1). These conditions 1 to 3 can be realized in the following manner. That is, tilted pulse of the same polarity and the same voltage as those of the pulse at the time of the addressing is applied between A and Y as the pulse for address disabling at the beginning of (TR1A, TR2A) of the addressing of the former half (TA1) and the latter half (TA2). Both the negative trapezoidal wave pulse (51, 55) and scan pulse (54, 58) are the pulses having the negative polarity and same voltage (v4). Note that, if the conditions 1 to 3 are satisfied, voltage waveform to be applied to Y in TR2A does not have to be trapezoidal wave, but for example, narrow-width pulse can be applied between A and Y.

Details of pulse forming the respective voltage waveforms will be described. First, in VA, there are positive rectangular wave pulse (31, 34) (voltage: v0) and address pulse (33, 36) (voltage: v0). Note that reference numerals 32, 35, 37, 41, 45, 47, 48, 61, 63, 64, and 65 denote reference potential (0V).

In VXo, in sequence, there are negative trapezoidal wave pulse 42 (lower limit voltage: v1), positive rectangular wave pulse (43, 44) (voltage: v2), positive rectangular wave pulse 46 (voltage: v3), and sustain pulse 49 (voltage: v3). In VXe, in sequence, there are positive rectangular wave pulse 62 (voltage: v3), negative trapezoidal wave pulse 66 (lower limit voltage: v1), positive rectangular wave pulse (67, 68) (voltage: v2), and sustain pulse 49 (voltage: v3).

In Vy, that is, Vyo and VYe, in sequence, there are negative trapezoidal wave pulse 51 (lower limit voltage: v4), positive trapezoidal wave pulse 52 (upper limit voltage: v5), negative trapezoidal wave pulse 53 (lower limit voltage: v4), scan pulse 54 (lower limit voltage: v4), negative trapezoidal wave pulse 55 (lower limit voltage: v4), positive trapezoidal wave pulse 56 (upper limit voltage: v5), negative trapezoidal wave pulse 57 (lower limit voltage: v4), scan pulse 58 (lower limit voltage: v4), and sustain pulse 59 (voltage: v3).

In TR1*a* of TR1 (address disable operation of Lo and Le and reverse side), as pulses for address disable, the positive rectangular wave pulse 31 is applied to A and the negative trapezoidal wave pulse 51 is applied to Yo. Xo and Xe are kept at 0V. Since the state where pulse (31, 51) is applied is the same as the voltage state applied between A and Y at the time of the address operation, a discharge state where address discharge does not occur appears after TR1*a*.

In TR1*b* (charge write operation of Lo) of the former half of TR1B, negative trapezoidal wave pulse 42 is applied to Xo, positive trapezoidal wave pulse 52 is applied to Yo, and positive rectangular wave pulse 62 is applied to Xe, and A is kept at 0V. In this case, Xo has a polarity reverse to Yo, and Xe has the same polarity as Yo. Therefore, charge is written to only Xo side.

In TR1*c* (charge adjustment operation of Lo) of the latter half of TR1B, positive rectangular wave pulse 43 is applied to Xo, negative trapezoidal wave pulse 53 is applied to Yo, and A and Xe are kept at 0V. On Xo side, the charge written in TR1*b* is adjusted by pulse (43, 53), and a charge state suitable for addressing is prepared. On Xe side, no reaction occurs here because charge is not written in TR1*b*.

In TA1 (address operation of Lo), address pulse 33 is applied to A, positive rectangular wave pulse 44 is applied to Xo, and scan pulse 54 is applied to Yo, and Xe is kept at 0V. Therefore, Lo is addressed.

TR2 has the waveform where VXo and VXe of TR1 are replaced, and in the same manner as in TR1, only Le side is put into a state where address operation is possible through TR2*a* (address disable operation of Lo and Le and reverse side), TR2*b* (charge write operation of Le), and TR2*c* (charge adjustment operation of Le).

In TA2 (address operation of Le), address pulse 36 is applied to A, scan pulse 58 is applied to Ye, positive rectangular wave pulse 68 is applied to Xe, and Xo is kept at 0V. Accordingly, Le is addressed.

In TS (sustain operation of Lo and Le), sustain pulse 49 is applied to Xo, sustain pulse 59 is applied to Yo, sustain pulse 69 is applied to Xe, sustain pulse 59 is applied to Ye, while alternately changing the polarity thereof between X and Y on a positive side. By this means, sustain discharge is performed, and light is emitted at Cs to be lit of Lo and Le.

As described above, according to the first embodiment, the number of Y bits is reduced to half from k to k/2 in comparison with the background structure 1.

Second Embodiment

Figure 14:
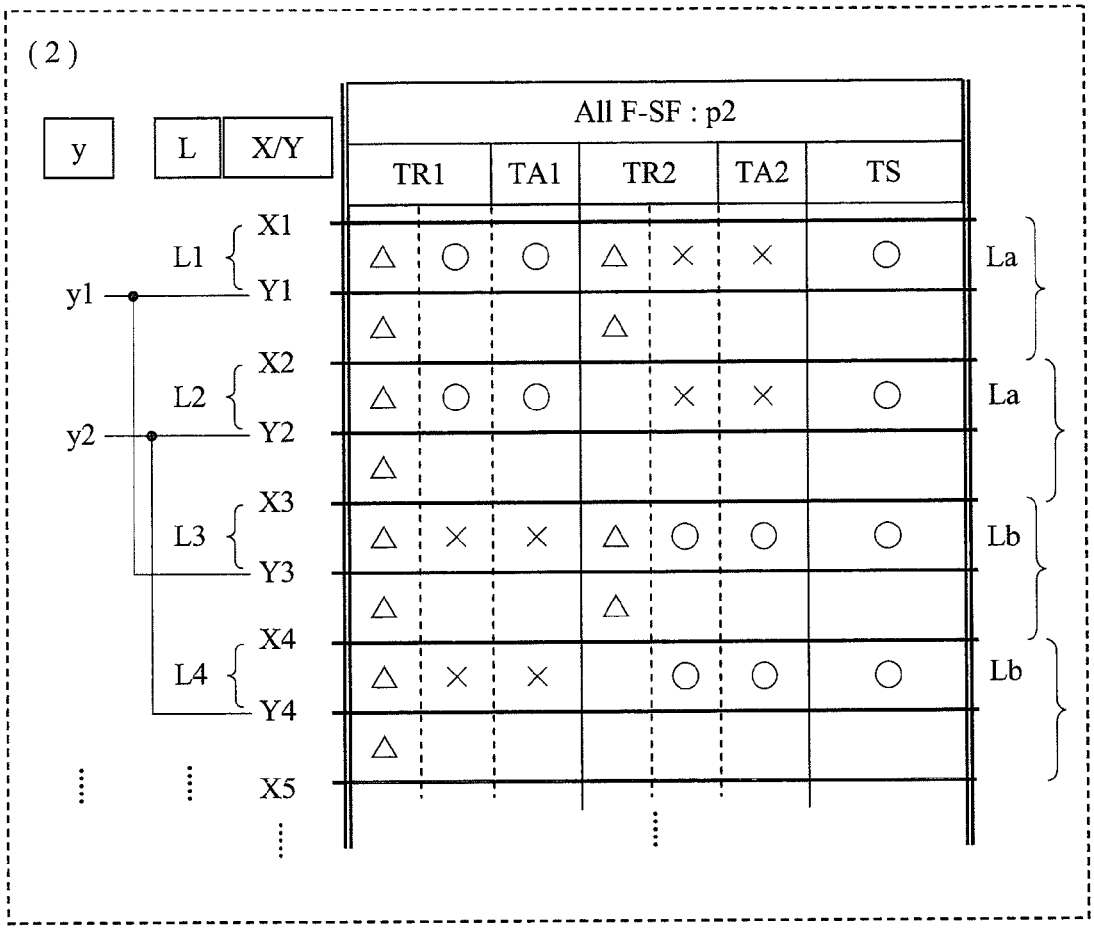
FIG. 14 is a diagram showing control objects and timings in a driving method of a PDP apparatus according to the second embodiment of the present invention.
Figure 15:
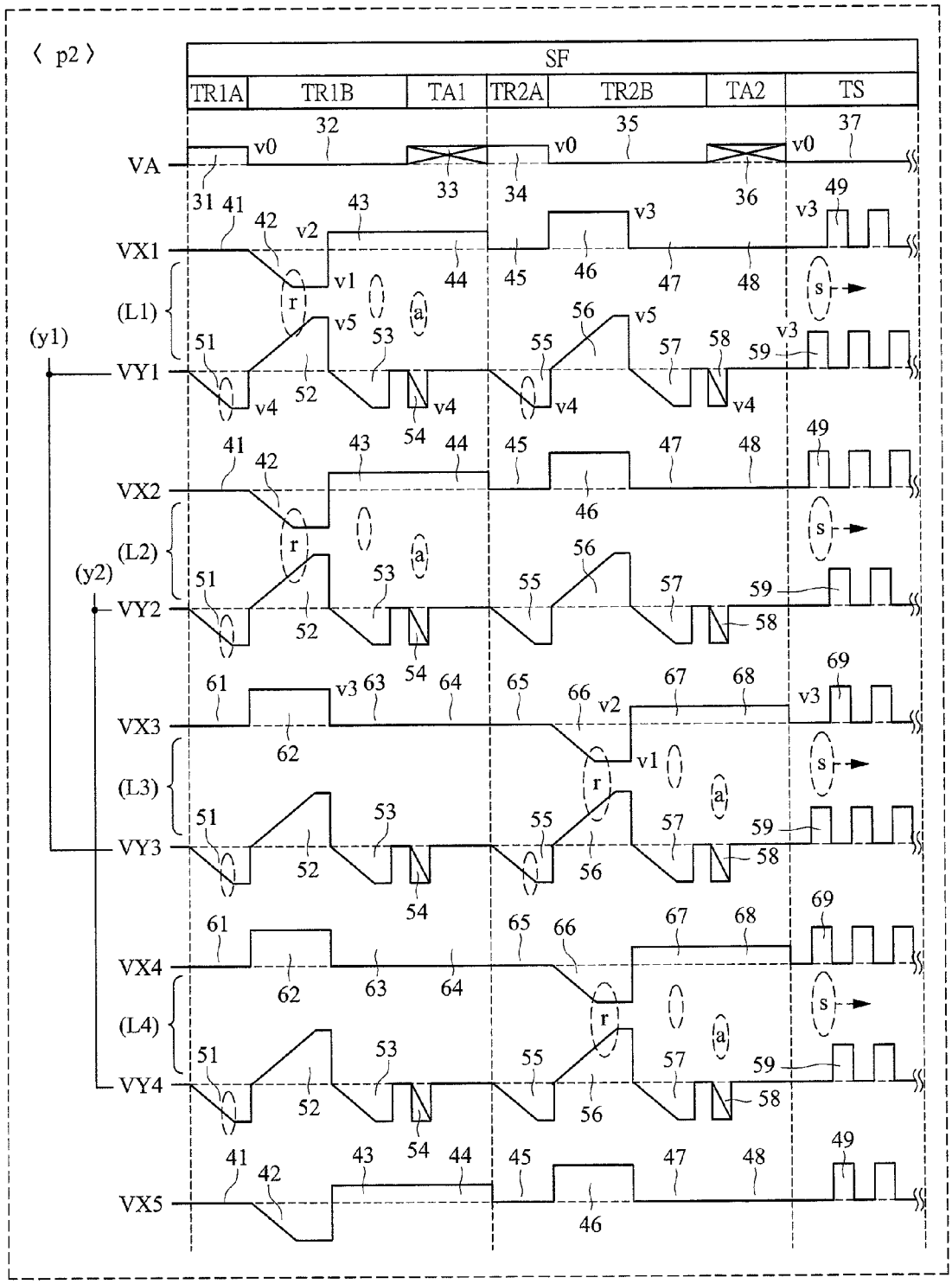
FIG. 15 is a diagram showing the structure of pattern (p2) of voltage waveforms in the driving method of a PDP apparatus according to the second embodiment of the present invention.

Next, a second embodiment of the present invention will be described with reference to FIG. 14, FIG. 15 and others. FIG. 14 shows the outline of driving control in the second embodiment. FIG. 15 shows a pattern (p2) of voltage waveforms in the driving control in the second embodiment corresponding to FIG. 14. In a structure of the second embodiment, on the basis of the background structure 2, as the second Y common connection structure (type: B), two adjacent Ys (even-numbered lines or odd-numbered lines) in every other Y of all of Ds (example: Y1, Y3) are connected by wiring y as a set unit (corresponding to (a3) in FIG. 9 and (a4) in FI10 and others). Also, as the corresponding voltage waveform, for example, the pattern (p2) shown in FIG. 15 is applied.

<Driving Control (2)>

In FIG. 14, in the second embodiment, in PDP (normal) of the background structure 2, in TS9, repeated sustain pulse is applied so that adjacent Ds (X, Y) on the reverse slit (non-object of drive display) side have the same phase (SSP). More specifically, for example, pulse is applied so that Y1 and X2 have the same phase and Y2 and X3 have the same phase. When only Ys are concerned, each Yo has the same phase and each Ye has the same phase, respectively.

In the second embodiment, driving control is performed by the application of the pattern (p2) to SF 6. Similar to the first embodiment, reset and address operation of the different Ls (example: L1, L3) are performed in the former and latter periods of the two stages, and the sustain discharge of both the Ls are performed at the same time in subsequent TS9.

As the Y common connection structure, when only Ys are concerned, two lines of Ys in every other Y are connected by y, that is, Y1 and Y3 are connected by y1 and Y2 and Y4 are connected by y2. For example, when voltage waveform (Vyl) is applied to wiring y1 from Ydr 152 side, the same voltage waveform (VY1, VY3) is applied to (Y1, Y3). When viewed as control unit corresponding to wiring y and a plurality of Ls, odd-numbered two Ls or even-numbered Ls, that is, two Ls in every other L (example: L1, L3) are connected by one wiring y (example: y1), thereby forming one control unit. Voltage waveforms of the same pattern are applied to respective control units.

In accordance with the two-stage reset and address operation control of control unit, one object and the other object to be operated separately in former and latter are defined as a and b, respectively. One side (Yi) of the two Ys in y (yi) is set as Ya {Y1, Y2, Y5, Y6, . . . } and the other side (Yi+2) is set as Yb {Y3, Y4, Y7, Y8, . . . }. Also, one side of corresponding 2L is set as La {L1, L2, L5, L6, . . . } and the other side thereof is set as Lb {L3, L4, L7, L8, . . . }.

Further, with regard to Xs, the same voltage waveform (VXa) is applied to each X (Xa) corresponding to Ya {X1, X2, X5, X6, . . . } and the same voltage waveform (VXb) is applied to each X (Xb) corresponding to Yb {X3, X4, X7, X8, . . . }, respectively. However, VXa have VXb have different polarities of sustain pulse in TS9 in accordance with SSP. The voltage waveforms (VXa, VXb) are those obtained by reversing pulses of first and second periods of the two-stage control.

In the drive display of control unit, in respective periods of the two stages, the reset and address operations including the address disable operation of the L on one side (La) and the L on the other side (Lb) corresponding to two Ys in each y are performed separately in former and latter in terms of time. At the same time, reverse slit sides thereof (example: Y1-X2, Y2-X3) are not operated by the voltage waveform including address disable operation.

In TR1 and TA1, after the address disabling, reset discharge and address discharge are generated only in the L on one side (La), thereby performing the addressing of a former half. In TR2 and TA2, after the address disabling, reset discharge and address discharge are generated only in the L on the other side (Lb), thereby performing the addressing of a latter half. Then, in TS9, sustain discharge is generated in the Ls (La, Lb) of both sides where the addressing has been completed. In TR1A, pulse for address disabling is applied to Y (y) and A, thereby putting the Ls on both sides of y and positive and reverse slits into an address disable state. In the next TR1B, by generating the reset discharge in La on one side, a charge state where address discharge can be generated is obtained. In next TA1, address discharge is generated only in La on one side. In TR2A, TR2B and TA2, address discharge is generated only in Lb on the other side in the same manner. Finally in TS, sustain discharge is generated in both Ls.

Voltage waveform to be applied to each Y for the above-described driving control is the same in two Ys in every other Y (example: Y1 and Y3) when only Ys are concerned. Accordingly, in the structure where they are commonly connected to wiring y (example: y1), they are driven by the application of the same voltage waveform (example: Vy1).

<Voltage Waveform (2)>

In FIG. 15, in the second embodiment, similar to the first embodiment, respective voltage waveforms {VX (VXa, VXb), Vy (VY), VA} are applied from a driver to (X, Y, A), respectively. In particular, there are voltage waveforms (VYa, VYb) to be applied from Ydr 152 to Y (Ya, Yb), that is, voltage waveform Vy to be applied to wiring y as Y set unit.

As the two-stage reset and address operation control in control unit, the same voltage waveform as Vy is applied to Ya and Yb for y. In TR1, address disabling in Ls (La, Lb) on both sides and positive and reverse slits and reset discharge (r) of the L on one side (La) are performed, and in TA1, address discharge (a) of the La is performed. In TR2, address disabling in Ls (La, Lb) on both sides and positive and reverse slits and reset discharge (r) of the L on the other side (Lb) are performed, and in TA2, address discharge (a) of the Lb is performed. Thereafter, in TS9, the Ls (La, Lb) on both sides are displayed at the same time by display discharge (s). Details of respective waveforms are the same as those in the first embodiment.

Note that, as a driving method thereof, for a control unit including two adjacent pairs of Ls (2 L: L1 and L2) (example: (L1, L2) and (L3, L4)), 2 L (L1, L2) on one side is first operated and 2 L (L3, L4) on the other side is operated next in the two-stage reset and address driving control. Thereafter, the sustain operation for both units of 2 L are performed at the same time.

As described above, according to the second embodiment, the number of Y bits is reduced to half from k to k/2 in comparison with the background structure 2.

Third Embodiment

Figure 16:
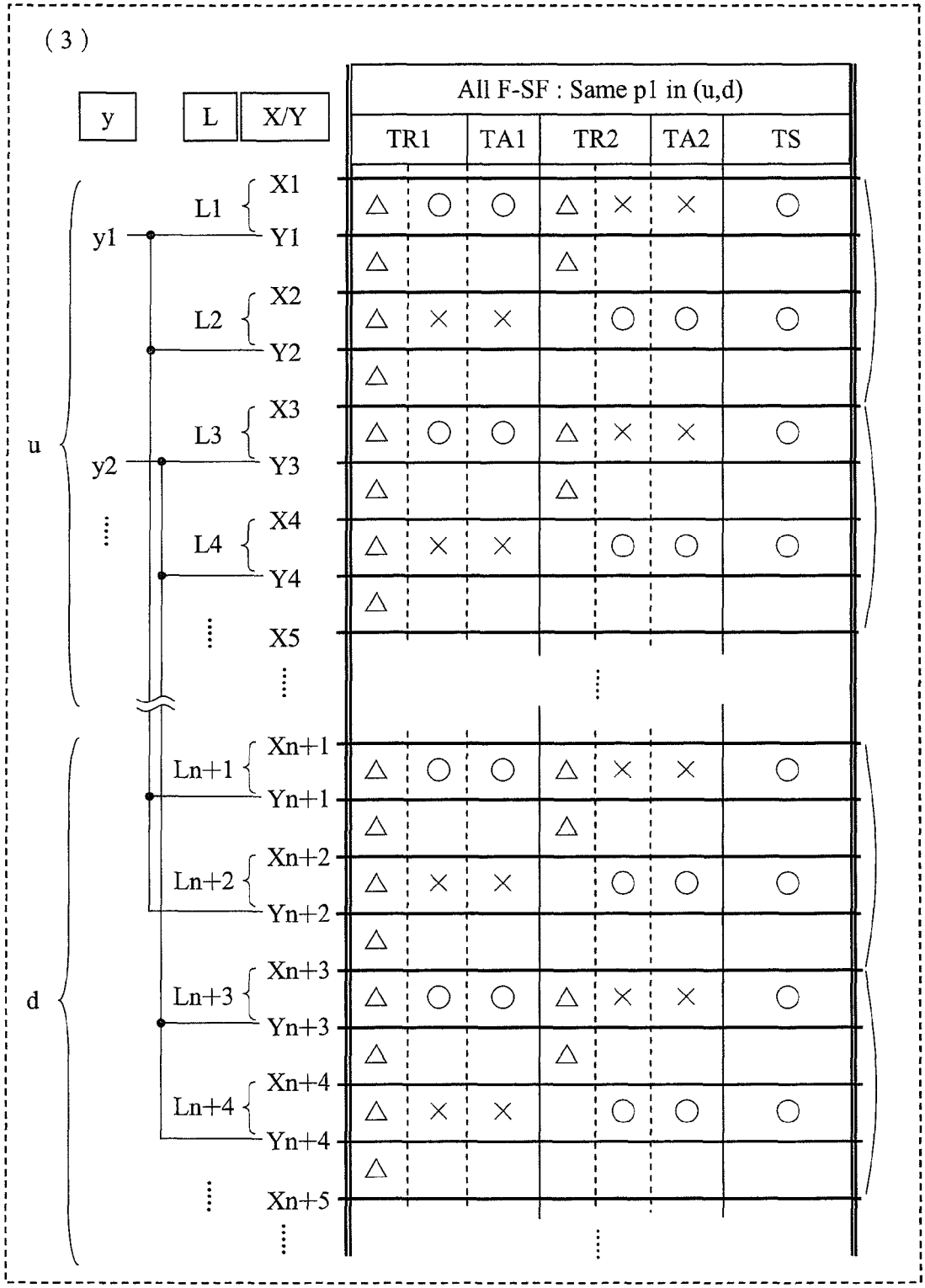
FIG. 16 is a diagram showing control objects and timings in a driving method of a PDP apparatus according to the third embodiment of the present invention.

Next, a third embodiment of the present invention will be described with reference to FIG. 16 and others. FIG. 16 shows the outline of driving control in the third embodiment. The third embodiment is different from the first embodiment in that it has the double A structure. In the structure of the third embodiment, on the basis of the background structure 3, as the third Y common connection structure (type: C), two adjacent Ys (example: Y1, Y2) in the upper area (u) and two adjacent Ys (example: Yn+1, Yn+2) in the lower area (d) at the position corresponding thereto in all Ds, that is, total of four Ys are connected by wiring y as set unit. This structure (C) is obtained by the application of the structure (A) to the areas (u, d). Also, as the corresponding voltage waveform, the pattern (p1) similar to that in the first embodiment is applied in (u, d) in the same manner.

<Driving Control (3)>

In FIG. 16, as an example, some initial lines in (u, d), that is, D (X1, Y1, . . . , Y4, X5), D (Xn+1, Yn+1, . . . , Yn+4, Xn+5), L (L1 to L4, Ln+1 to Ln+4), y1 and y2 are shown. Details of drive waveform are the same as those of p1 in the first embodiment in respective areas (u, d). In TS9, non SSP is used.

The same voltage waveform: VAu, VAd as the VA is applied to Au and Ad.

Note that, in PDP (normal) of the background structure 3, in accordance with the double A structure, respective Ds (X, Y) of the upper and lower areas (u, d) are expressed as follows by use of the number of Ls (k). First, in the upper area u, n lines of Xs {X1, . . . , Xn} and n lines of Ys {Y1, . . . , Yn} are sequentially arranged repeatedly, and Ls {L1, . . . , Ln} (Lu) are formed. Further, in the lower area d, n lines of Xs {Xn+1, X2*n*} and n lines of Ys {Yn+1, . . . , Y2*n*} are sequentially arranged repeatedly, and Ls {Ln+1, . . . , L2*n*} (Ld) are formed. In total, h=2n lines of Xs and Ys (2*h* lines of Ds) and k=h lines of L are disposed.

As the Y common connection structure, two adjacent Ys in the areas (u, d), that is, total of four Ys are commonly connected to wiring y. Accordingly, n/2 lines of ys (y1, . . . , yn/2) are formed. For example, Y1, Y2, Yn+1, and Yn+2) connected to y1 becomes one control unit. Voltage waveforms of the same pattern are applied to respective control units. Further, with regard to Xs, similar to the first embodiment, the same voltage waveform VXo is applied to each Xo and the same voltage waveform VXe is applied to each Xe in the respective areas (u, d).

In the drive display of control unit, in former and latter periods of the two-stage control using address disable operation, the reset and address operations are performed separately in odd-numbered Ls in (u, d) (example: L1, Ln+1) and even-numbered Ls in (u, d) (example: L2, Ln+2) of odd and even Ls (Lo, Le) in (u, d), and in next TS, the sustain discharge of the Ls (Lo, Le) on both sides is similarly performed. At the same time, the reverse sides thereof are not operated by the voltage waveform including address disable operation.

As described above, according to the third embodiment, the number of Y bits is reduced to ¼ from k to k/4 in comparison with the background structure 3.

Fourth Embodiment

Figure 17:
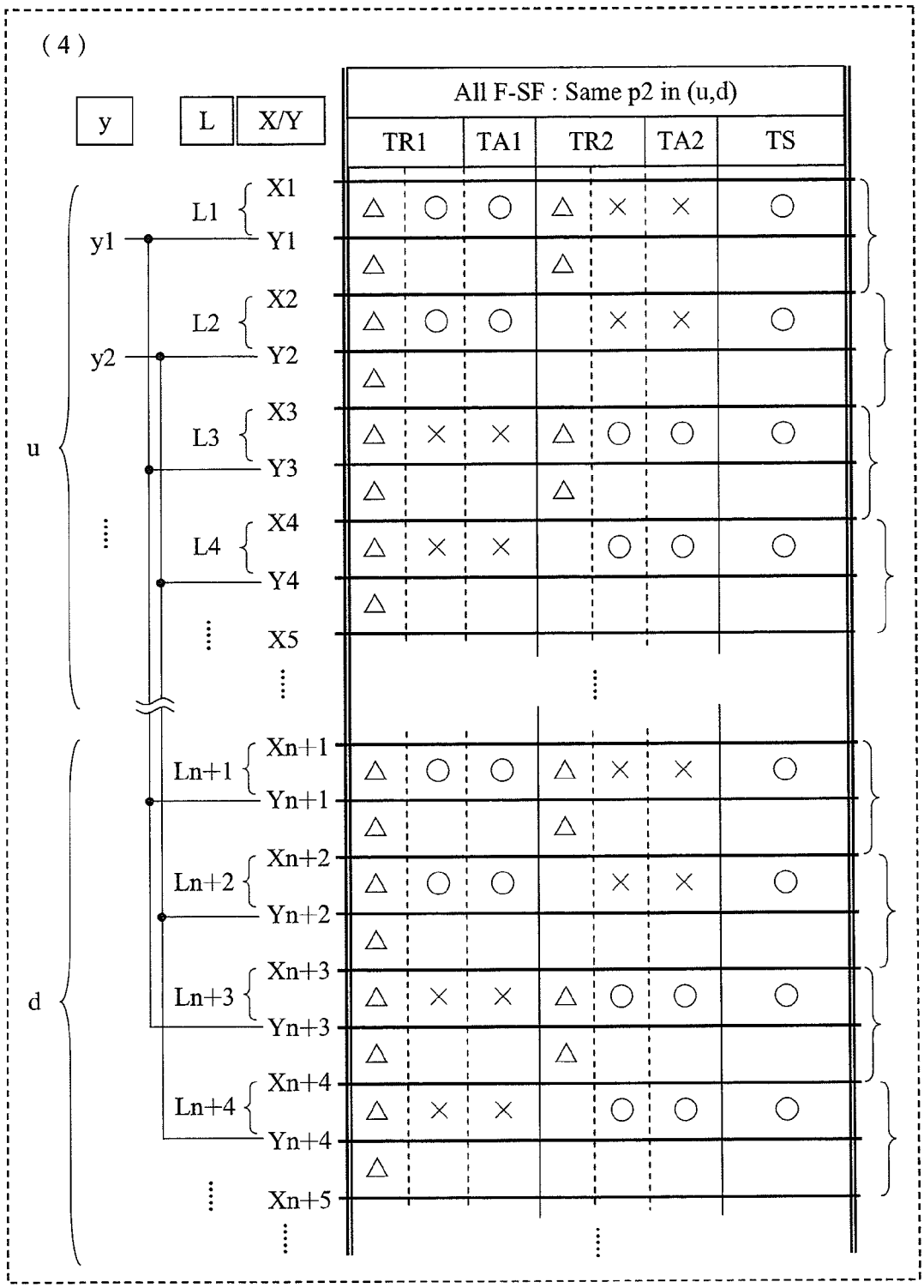
FIG. 17 is a diagram showing control objects and timings in a driving method of a PDP apparatus according to the fourth embodiment of the present invention.

Next, a fourth embodiment of the present invention will be described with reference to FIG. 17 and others. FIG. 17 shows the outline of driving control in the fourth embodiment. The fourth embodiment is different from the second embodiment in that it has the double A structure. In the present embodiment, the connection portion structures on the circuit side (a1 to a4) are applied in particular. In the structure of the fourth embodiment, on the basis of the background structure 4, as the fourth Y common connection structure (type: D), in all Ds, two adjacent lines of Ys in every other Y (example: Y1, Y3) of the Ys on the u side and two adjacent Ys (example: Yn+1, Yn+3) at the position corresponding thereto on the d side, that is, total of four Ys are connected by wiring y as a set unit. This structure (D) is obtained by a combination with the structure (B) to (u, d). Also, as the corresponding voltage waveform, the same pattern (p2) as that of the second embodiment is applied to (u, d) in the same manner.

<Driving Control (4)>

In FIG. 17, as an example, similar to FIG. 16, some initial lines in (u, d) are shown. Details of drive waveform are the same as those of p2 in the second embodiment in respective areas (u, d). In TS9, different from the third embodiment, SSP is used.

In the PDP (normal) of the background structure 4, in the same manner as that in the background structure 3, n lines of Xs and n lines of Ys are sequentially arranged repeatedly in the upper and lower areas (u, d) to form the Lu and Ld, respectively. In TS9, repeated sustain pulse is applied so that Ds (X, Y) of reverse slits have the same phase (SSP). When only Ys are concerned, Yo have the same phase and Ye have the same phase.

As the Y common connection structure, n/2 lines of y (y1, . . . , yn/2) are formed. For example, Y1, Y3, Yn+1 and Yn+3 connected by y1 form a control unit. Voltage waveforms of the same pattern are applied to respective control units. Further, with regard to X, similar to the second embodiment, the same voltage waveform (VXa) is applied to each X (Xa) corresponding to Ya and the same voltage waveform (VXb) is applied to each X (Xb) corresponding to Yb, respectively. However, VXa and VXb have different polarities of sustain pulse in TS9 in accordance with SSP.

In the drive display of control unit, in respective periods of the two-stage control using address disable operation, reset and address operation including address disable operation is separately performed in one side of Ls (example: L1, Ln+1) and the other side of Ls (example: L3, Ln+3) of the Ls (La, Lb) in (u, d) corresponding to Ya and Yb, respectively. Then, in the subsequent TS, sustain discharge is simultaneously performed in both the sides (La, Lb). At the same time, reverse sides thereof are not operated by voltage waveform including address disable operation.

Voltage waveform to be applied to each Y for the above driving control becomes the same in Ys (example, Y1, Y3, Yn+1, Yn+3) corresponding to the two adjacent Ls (example: La and Lb) in every other L in (u, d), respectively. Accordingly, these are commonly connected to wiring y (example: y1), and the same voltage waveform (example: Vy1) is applied thereto for driving.

As described above, according to the fourth embodiment, the number of Y bits is reduced to ¼, that is, from k to k/4, ¼ in comparison with the background structure 4.

Fifth Embodiment

Figure 18:
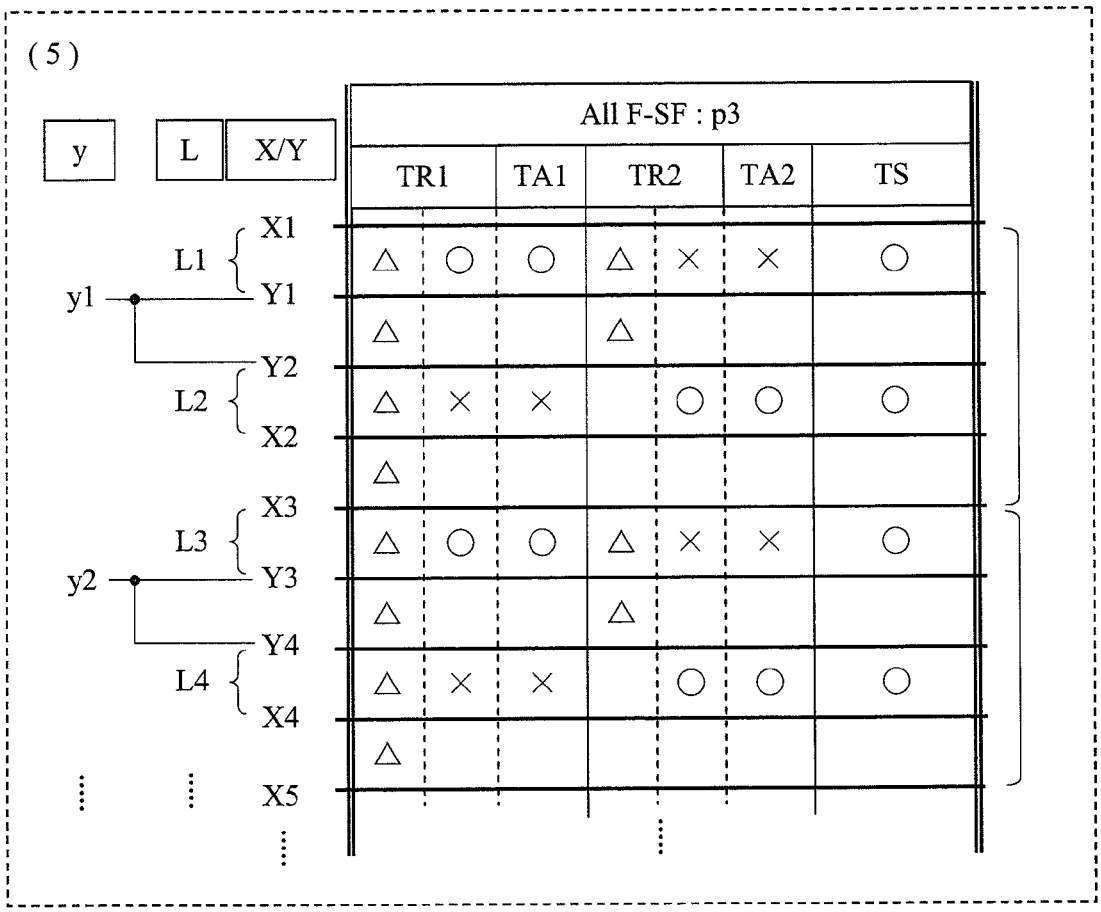
FIG. 18 is a diagram showing control objects and timings in a driving method of a PDP apparatus according to the fifth embodiment of the present invention.
Figure 19:
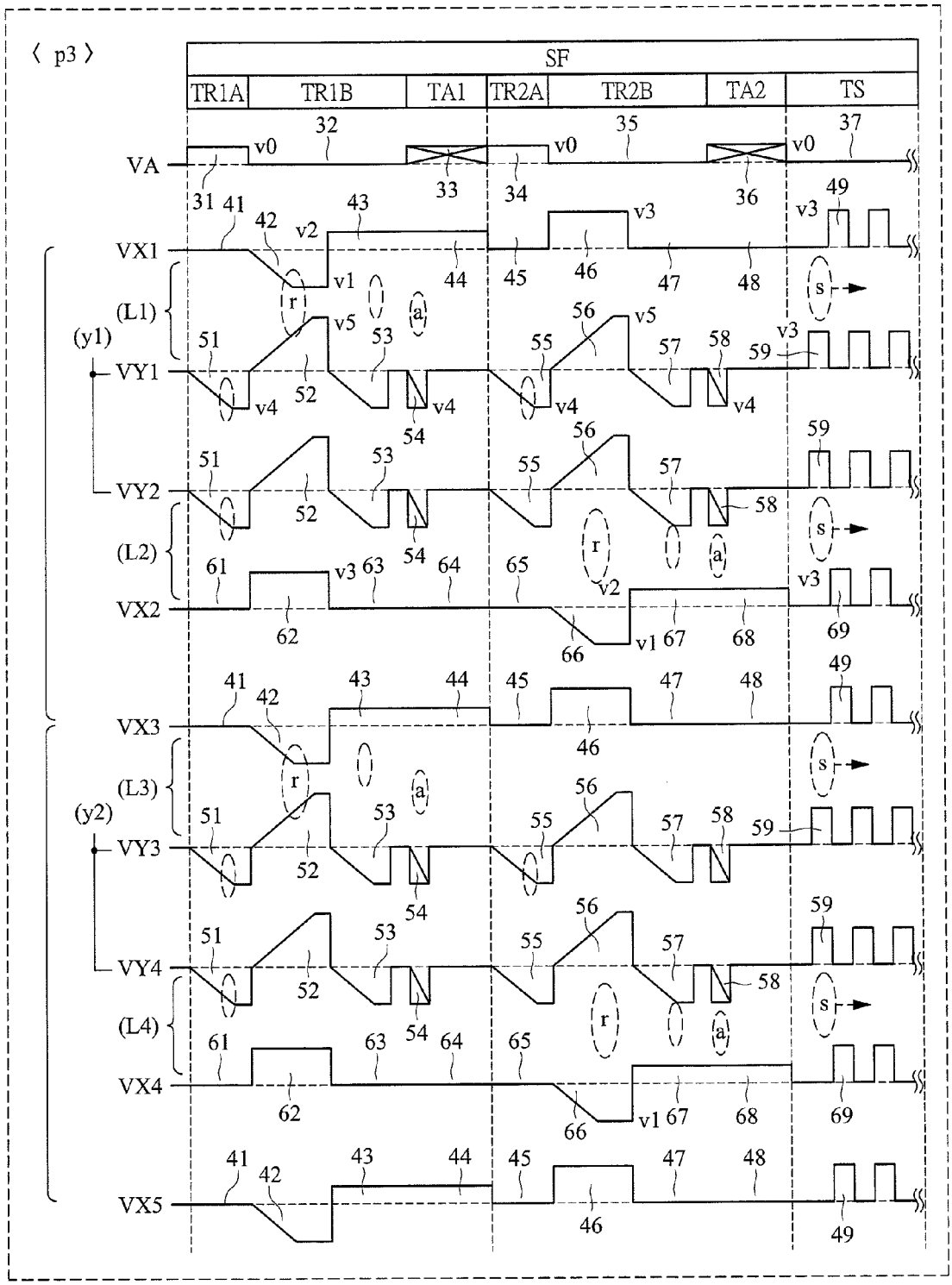
FIG. 19 is a diagram showing the structure of pattern (p3) of voltage waveforms in the driving method of a PDP apparatus according to the fifth embodiment of the present invention.

Next, a fifth embodiment of the present invention will be described with reference to FIG. 18 and others. FIG. 18 shows the outline of driving control in the fifth embodiment. FIG. 19 shows a pattern (p3) of voltage waveforms of driving control in the fifth embodiment corresponding to FIG. 18. The fifth embodiment is different from the first embodiment in that it has reverse repeated arrangement structure of X and Y and SSP structure. In the fifth embodiment, on the basis of the background structure 5, the same Y common connection structure (A) as that of the first embodiment is used, and p3 is used as the corresponding voltage waveform. In accordance with the reverse repeated arrangement structure of X and Y, adjacent Ys on reverse slit are commonly connected.

<Driving Control (5)>

In FIG. 18, driving control is similarly performed by the application of the pattern (p3) to SF 6. In the fifth embodiment, in PDP (normal) of the background structure 5, for example, Ls by the reverse repetition of Ds (X, Y) are arranged like L1 (X1, Y1) and L2 (Y2, X2), and only (Xo–Yo) and (Ye–Xe) sides become the objects of the drive display. Meanwhile, Ls are not formed on the reverse side and do not become the objects of the drive display. In TS9, repeated sustain pulse is applied so that Xs have the same phase and Ys have the same phase (non SSP).

As the Y common connection structure, two adjacent Ys in a reverse slit when only Ys are concerned are commonly connected to wiring y. For example, Y1 and Y2 are connected to y1 and Y3 and Y4 are connected to y2. When viewed as control unit, one wiring y (example: y1) is connected to two adjacent Ls (example: L1, L2) to form one control unit. Voltage waveforms of the same pattern are applied to respective control units. Further, with regard to Xs, the voltage waveform (VXo) is applied to each Xo unit and the voltage waveform (VXe) is applied to each Xe unit.

In the drive display of control unit, in the respective periods of the two stages, the reset and address operation is separately performed in the odd-numbered Ls (Lo) and the even-numbered Ls (Ls). For example, in the former half, the operation on the Lo side is performed, and in the latter half, the operation on the Le side is performed. At the same time, reverse sides thereof (example: Y1-Y2, X2-X3) are not operated by voltage waveform including address disable operation.

In TR1A, pulse for address disabling is applied to Y (y) and A. By this means, Ls (Lo, Le) of Ys on both sides of y and reverse slit (example: Y1-Y2) are put into an address disable state. In the next TR1B, reset discharge is generated in the Lo on one side, and in the next TA1, the address discharge is generated only in the Lo. Meanwhile, in TR2A, TR2B, and TA2, reset discharge and address discharge are generated only in the L (Le) on the other side in the same manner. Finally in TS, sustain discharge is performed in both the Ls (Lo, Le) on both sides.

With regard to voltage waveform to be applied to each Y for the above-described driving control, the same voltage waveform is applied to two adjacent Ys (Yo and Ye) when only the Ys are concerned. Accordingly, they are commonly connected to wiring y (example: y1), and the same voltage waveform (example: Vy1) is applied thereto for driving.

<Voltage Waveform (5)>

In FIG. 19, similar to the first embodiment, there are respective voltage waveforms {VX, VY (Vy), VA}. The same voltage waveforms can be applied repeatedly to each control unit. As the two-stage reset and address operation control, in adjacent VYo and VYe, the same voltage waveform is applied as Vy. Further, the same voltage waveforms are applied to VXo unit and the same voltage waveforms are applied to VXe, respectively. In TR1, address disabling in respective Ls (Lo, Le) and reverse side and reset discharge (r) on one side (Lo) are performed, and address discharge (a) in the Lo is performed in TA1. Next, in TR2, address disabling in each L (Lo, Le) and reverse side and reset discharge (r) on the other side are performed, and address discharge (a) in the Lo is performed in TA2. Thereafter, in TS9, Ls (Lo, Le) on both sides are displayed at the same time by display discharge (s).

As described above, according to the fifth embodiment, the number of Y bits is reduced to half from k to k/2 in comparison with the background structure 5.

Sixth Embodiment

Next, a sixth embodiment of the present invention will be described with reference to FIG. 20 and others. FIG. 20 shows the outline of driving control in the sixth embodiment. The sixth embodiment is different from the fifth embodiment in that it has the double A structure and the Y common connection structure (C). In the sixth embodiment, on the basis of the background structure 6, the same Y common connection structure (C) as in the third embodiment is used, and as the corresponding voltage waveform, the same pattern (p3) as that of the fifth embodiment is applied to (u, d) in the same manner.

<Driving control (6)>

In FIG. 20, as an example, some initial lines in the areas (u, d) are shown. Details of drive waveform are the same as those of p3 in the fifth embodiment in respective areas (u, d). The driving control is similarly performed by the application of the pattern (p3) to SF 6.

In the sixth embodiment, in the PDP (normal) of the background structure 6, Ls by the reverse repetition of Ds (X, Y) are arranged in the respective areas (u, d). In TS9, repeated sustain pulse is applied so that Xs have the same phase and Ys have the same phase (SSP).

As the Y common connection structure, two adjacent Ys in the respective areas (u, d), that is, total of four Ys are commonly connected to wiring y. Therefore, n/2 lines of ys (y1, yn/2) are formed. For example, four lines of Ys (Y1, Y2, Yn+1, Yn+2) form a Y set unit. The control unit is formed in accordance with the 4 L in (u, d). Voltage waveforms of the same pattern are applied to respective control units. Further, with regard to Xs, similar to the fifth embodiment, the same waveform VXo is applied to each Xo and the same waveform VXe is applied to each Xe in the areas (u, d).

In the drive display of control unit, in respective periods of two stages, the reset and address operation is separately performed in the odd-numbered Ls on one side (example: L1, Ln+1) and the even-numbered Ls on the other side (example: L2, L+2) of the Ls (Lo, Le). In the subsequent TS, sustain discharge is simultaneously performed in the Ls on both sides. The reverse sides thereof (example: Y1–Y2, X2–X3, Yn+1–Yn+2, Xn+2–Xn+3) are not operated by the voltage waveform including address disable operation.

With regard to voltage waveform to be applied to each Y for the above-described driving control, the same voltage waveform is applied to the total of four lines forming the two adjacent Ys (Yo and Ye) in the respective areas (u, d). Accordingly, they are commonly connected to wiring y, and the same voltage waveform is applied thereto for driving.

As described above, according to the sixth embodiment, the number of Y bits is reduced to ¼, that is, from k to k/4 in comparison with the background structure 6.

Seventh Embodiment

Figure 21:
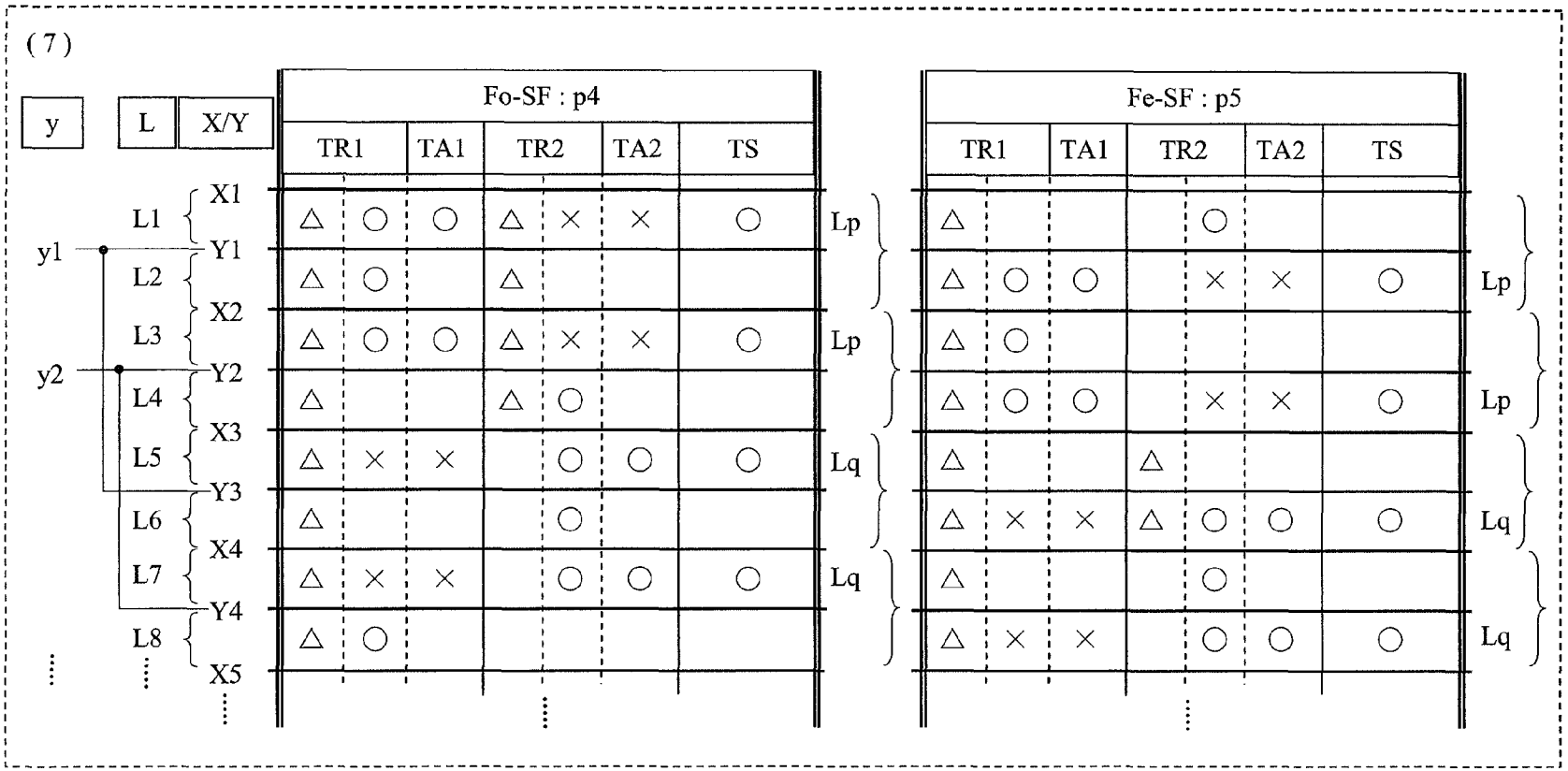
FIG. 21 is a diagram showing control objects and timings in a driving method of a PDP apparatus according to the seventh embodiment of the present invention.
Figure 22:
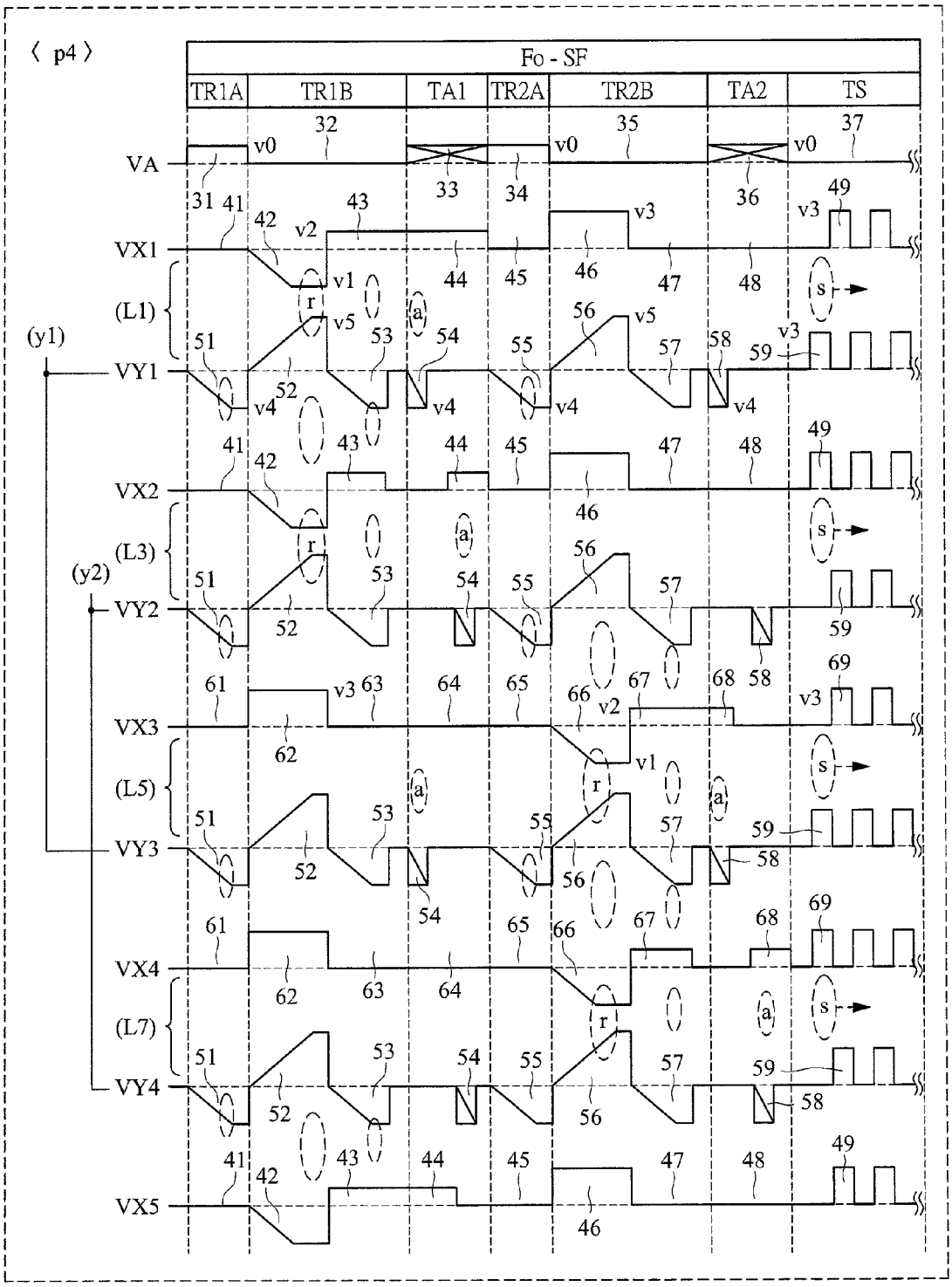
FIG. 22 is a diagram showing the structure of pattern (p4) of voltage waveforms in an odd-numbered field in the driving method of a PDP apparatus according to the seventh embodiment of the present invention.
Figure 23:
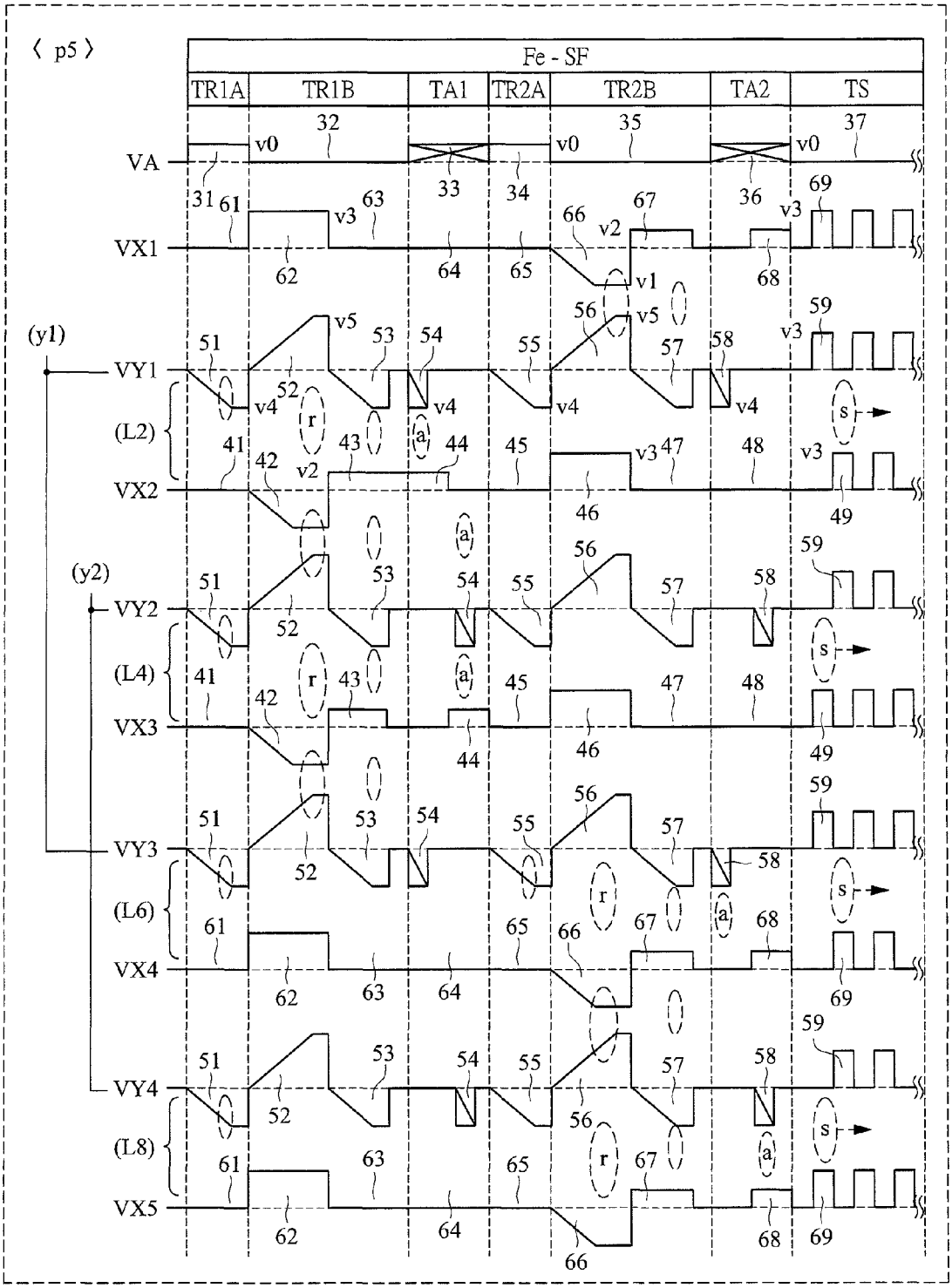
FIG. 23 is a diagram showing the structure of pattern (p5) of voltage waveforms in an even-numbered field in the driving method of a PDP apparatus according to the seventh embodiment of the present invention.

Next, a seventh embodiment of the present invention will be described with reference to FIG. 21 and others. FIG. 21 shows the outline of driving control in the seventh embodiment. FIG. 22 and FIG. 23 show patterns (p4, p5) of voltage waveforms of driving control in the seventh embodiment corresponding to FIG. 21. The seventh embodiment is different from the second embodiment in that it has the second structure. In the seventh embodiment, on the basis of the background structure 7, the Y common connection structure (B) similar to that in the second embodiment is used, and the patterns (p4, p5) shown in FIG. 22 and FIG. 23 are used as the corresponding voltage waveforms.

<Driving control (7)>

In FIG. 21, in PDP (ALIS and interlace driving method) of the background structure 7, it has the alternate arrangement structure of X and Y and the single A structure, and it uses SSP. In the seventh embodiment, similar to the interlace driving method of the background structure 7, odd-numbered Ls and even-numbered Ls (Lo, Le) are alternately driven and displayed in the odd-numbered field (Fo) and even-numbered field (Fe), respectively.

In the seventh embodiment, in the PDP of the background structure 7, for example, Ls (Lo, Le) are formed of all two adjacent Ds (X, Y) such as L1 (X1, Y1), L2 (Y1, X2), L3 (X2, Y2), and L4 (Y2, X3).

As the Y common connection structure, two lines of Ys in every other Y when only Ys are concerned are connected by y. More specifically, Y1 and Y3 are connected to y1, and Y2 and Y4 are connected to y2. For example, when voltage waveform (Vy1) is applied from Ydr 152 side to wiring y1, the voltage waveform VY1 is applied to Y1 and the voltage waveform VY3 is applied to Y3.

When viewed as a control unit, wiring y (example: y1) is connected to Ls (example: L1, L2, L5, L6) corresponding to two lines of Ys in every other Y to form one control unit. Further, in accordance with two adjacent wirings (example: y1, y2), a control unit is formed of 8 L. To other areas, voltage waveforms in the same pattern can be applied. Further, with regard to Xs, for example, respectively the same voltage waveforms are applied to Xs corresponding to four types such as (X1, X2, X3, X4).

As the interlace driving method, Ls (Lo, Le) alternately becomes the object of drive display for each field 5. Driving control is performed by p4 to each SF6 of the Fo, and driving control is performed by p5 to each SF6 of the Fe. Note that L on the side to be an object of drive display is referred to as a positive slit (positive side), and L on the side not to be an object thereof is referred to as a reverse slit (reverse side). In this example, Lo becomes the positive side in Fo, and Le becomes the positive side in Fe. By the voltage waveform including address disable operation, except a part of discharge, address and sustain operation is not performed on the reverse side.

In TS9, repeated sustain pulse is applied so that adjacent electrodes (X, Y) interposing the reverse slit therebetween have the same phase (SSP). More specifically, at the time of Fo, it is applied so that Y1–X2 have the same phase and Y2 and X3 have the same phase, for example. When only the Ys are concerned, Yo have the same phase and Ye have the same phase, respectively.

In the drive display of control unit, two-stage reset and address operation control including address disable operation is used in SF6. By use of the address disable operation, the reset operation and the address operation of the different Ls in the Y set unit are separately performed in two stages of former and latter, and the sustain discharges of the Ls on both sides are simultaneously performed in subsequent TS9.

In accordance with the two-stage reset and address operation control, one side of the two Ys of the Y set unit for y is defined as p and the other side thereof is defined as q. That is, Yi side for the y1 is defined as Yp {Y1, Y2, Y5, Y6, . . . } and Yi+2 side for yi is defined as Yq {Y3, Y4, Y7, Y8, . . . }. Accordingly, Lp {L1 to L4, L9 to L12, . . . } and Lq {L4 to L8, L13 to L16, . . . } are defined.

For the Y set unit, in former and latter periods, one side of Lp and Lq and either of Lo and Le according to Fo/Fe become the objects of reset and address operation. For example, in the control unit of y1 and y2, at the time of Fo, (L1, L3) which are the Lp on the Lo side become the objects in the former half, and (L5, L7) which are the Lq on the Lo side become the objects in the latter half. Similarly, at the time of Fe, (L2, L4) which are the Lp on the Le side become the objects in the former half, and (L6, L8) which are Lq on the Le side become the objects in the latter half. Addressing is separately performed so that it is performed on the Lp side at the first stage (TA1) and it is performed on the Lq side at the second stage (TA2). At the same time, reverse side (Le at Fo, Lo at Fe) is not operated by the voltage waveform including address disable operation.

In details, for example, at the time of Fo, in the TR1 and TA1 of the former half, after the address disabling of the L1 to L4 and L5 to L8 corresponding to Y1, Y2 and Y3, Y4, reset discharge and address discharge are generated in L1 and L3. In this manner, the addressing of the former half is performed. In the TR2 and TA2 of the latter half, after the address disabling of the L1 to L4 corresponding to Y1 and Y2 (since the address disabling has been already performed in L5 to L8 corresponding to Y3, Y4 in the former half, it is omitted), reset discharge and address discharge are generated in L5 and L7. In this manner, the addressing of the latter half is performed. Then, in TS9, sustain discharge is generated in Lo (L1, L3, L5, L7) where the addressing has been completed. Further, at the time of Fe, similarly, in the TR1 and TA1, after the address disabling of each L, the reset discharge and the address discharge are generated in L2 and L4, thereby performing the addressing of the former half. In TR2 and TA2, after the address disabling of each L, the reset discharge and the address discharge are generated in L6 and L8, thereby performing the addressing of the latter half. Thereafter, in TS9, sustain discharge is generated in Le (L2, L4, L6, L8).

In TR1A, pulse for address disabling is applied to each Y of Yp and Yq and A. By this means, the positive and reverse slits on both sides of the Y are put into an address disable state. In the next TR1B, reset discharge is generated in L (example: L1, L3) of one side (p) on the positive side (example: Lo), thereby obtaining a charge state where address discharge can be generated. In next TA1, address discharge is generated in only the L (L1, L3) on the one side (p) which is in a charge state where address discharge can be generated by the reset discharge in the former stage. Similarly in TR2A, TR2B, and TA2, in only the L (example: L5, L7) of the other side (q), address discharge is generated through the address disable operation and the reset discharge in the same manner. Finally in TS, sustain discharge is performed Ls (Lo) of both sides (p, q).

With regard to the voltage waveform to be applied to each Y for the above-described driving control, in Fo and Fe, the same voltage waveform is applied to the two Ys in every other Y (example: Y1 and Y3, Y2 and Y4) when only the Ys are concerned. Accordingly, they are commonly connected to wiring y (example: y1, y2) as mentioned previously, and they are driven by the application of the same voltage waveforms (example: Vy1, Vy2), respectively.

<Voltage Waveform (7)>

In FIG. 22 and FIG. 23, there are respective voltage waveforms {VX, VY (Vy), VA} to be applied from driver to (X, Y, A). As examples, there are VX {VX1 to VX5} and VY {VY1 to VY4} corresponding to Ds (X1, Y1, . . . , Y4, X5). In particular, there are voltage waveforms Vy {Vy1, Vy2} to be applied from Ydr 152 to wiring y (y1, y2) of Y set unit.

As the two-stage reset and address operation control in control unit, the same voltage waveform is applied as Vy to every other Y such as Yi (Yp) and Yi+2 (Yq). Hereinafter, the description will be made for p4 at the Fo, but p5 at the Fe is approximately the same except for the voltage waveform corresponding to the switching of positive and reverse (Lo, Le) In the SF6 at the Fo, address disabling of the Ls on both sides of each Y and reset discharge (r) of Lo on one side (p) of Y set unit are performed in the first stage (TR1) of TR7, and address discharge (a) in the L is performed in the first stage (TA1) of TA8. Address disabling of the Ls on both sides of each Y and reset discharge (r) of the Le on the other side (q) of the Y set unit are performed in the second stage (TR2) of TR7, and address discharge (a) in the L is performed in the second stage (TA2) of TA8. Thereafter, Ls (Lo) of both (p, q) are simultaneously displayed by display discharge (s) in TS9.

The following is the description about driving control of the control unit at Fo. In TR1A, address disable operation is performed. As shown by VA and VY, rectangular wave pulse 31 is applied to A, and negative trapezoidal wave pulse 51 is applied to two lines of Ys in every other Y, that is, to y. VX is kept at reference potential (0V). In this manner, discharge (discharge for address disabling) is generated from A to Y, and wall charge is formed on Y. By this means, all the positive and negative Ls (Lo and Le) formed of pairs of a Y and its adjacent upper Xo and a Y and its adjacent lower Xe are put into a charge state where discharge (a) for addressing is not generated in next TA8 unless discharge (r) for initialization (reset) is generated (state where addressing is impossible).

Next, in TR1B, discharge (r) is generated in Lo on one side (p), and only the L is initialized (reset) to put it into an addressing possible state. Next, in TA1, discharge (a) is generated in L on one side (p), and addressing of the L is performed.

Next, in the same manner as TR1A, in TR2A, discharge is generated from A to two adjacent Ys, and wall charge is formed on Y. By this means, the Y and all the positive and negative Ls (Lo and Le) on both the upper and lower sides thereof (in particular, Lp side) are put into an address disable state. Next, in TR2B, discharge (r) is generated in Lo on the other side (q), and only the L is initialized to put it into an addressing possible state. Next, in TA2, discharge (a) is generated in Lo on the other side (q), and the addressing of the L is performed.

Then, in the sustain operation in TS9, first, voltage (sustain pulse) is applied from each Y to one upper X to generate display discharge (s) in Yi-Xi (Lo), and then secondly, voltage (sustain pulse) is applied in reverse polarity from the X to Y to generate display discharge (s) in the Lo. Thereafter, these operations are repeated. By this means, all the Lo of (p, q) are displayed at the same time. Further, the conditions similar to those in the description of voltage waveform (1) in the first embodiment should be satisfied in TR2A.

Details of the pulse forming the respective voltage waveforms will be described. There are respective pulses (31 to 37, 41 to 49, 51 to 59, 61 to 69) approximately the same as those described in the voltage waveform (1). The reset and address operation of the L on one side (p) and C are performed in the former half of the two stages, and the reset and address operation of the L on the other side (q) and C are performed in the latter half thereof.

At TR1*a* (address disable operation of positive and reverse Ls), the pulse 31 is applied to A and the pulse 51 is applied to Yo as pulses for address disabling, and each X of (p, q) is kept at 0V. Since the state where pulses (31, 51) are applied is the same as the voltage state to be applied between A and Y at the address operation, a charge state where address discharge is not generated is obtained after TR1*a*.

In TR1*b* (charge write operation of Lo on p side), the pulse 42 is applied to the X (example: X1, X2) on p side, the pulse 52 is applied to Y, and the pulse 62 is applied to the X (example: X3, X4) on q side, and A is kept at 0V. In this case, since X and Y on the p side have reverse polarities, and X and Y on the q side have the same polarity, charge is written to only the p side (example: L1, L2, L3).

In TR1*c* (charge adjustment operation of Lo on p side), the pulse 43 is applied to X on p side, the pulse 53 is applied to Y, and A and X on q side are kept at 0V. In the X on the p side, charge written in TR1*b* is adjusted by the pulse (43, 53), and a charge state suitable for addressing is obtained. In the X on the q side, no reaction occurs here because nothing is written in TR1*b*.

In TA1 (address operation in Lo on p side), the pulse 33 is applied to A, the pulse 44 is applied to X on p side, and the pulse 54 is applied to Y, and X on q side is kept at 0 V. By this means, Lo on p side is addressed.

In TR2, waveforms obtained by replacing VX of TR1 by (p, q) are provided, and in the same manner as TR1, through TR2*a* (address disable operation of positive and reverse Ls), TR2*b* (charge write operation in Lo on q side), and TR2*c* (charge adjustment operation in Lo on q side), only the Lo on q side is put into a state where an address operation can be performed.

In TA2 (address operation of Lo on q side), the pulse 36 is applied to A, the pulse 58 is applied to Y, and the pulse 68 is applied to X on q side, and X on the p side is kept at 0V. By this means, Lo on q side is addressed.

In TS (sustain operation of Lo), by the SSP, the pulse 49 is applied to X on p side, the pulse 59 is applied to Y, and the pulse 69 is applied to X on q side, while repeatedly changing the polarities between X and Y of Lo. By this means, sustain discharge is performed, and light is emitted at lighting objects C of Lo.

Note that, in FIG. 22, in the adjacent wirings y1 and y2, that is, in the VY, for example, VY1 and VY2, timing of applying scan pulses (54, 58) in TA1 and TA2 is different in the former half (p) and the latter half (q). Accordingly, in the VX, for example, VX1 and VX2, timing of applying the pulses (44, 68) is different.

As described above, according to the seventh embodiment, the number of Y bits is reduced to half from k/2 to k/4 in comparison with the background structure 7.

Eighth Embodiment

Figure 24:
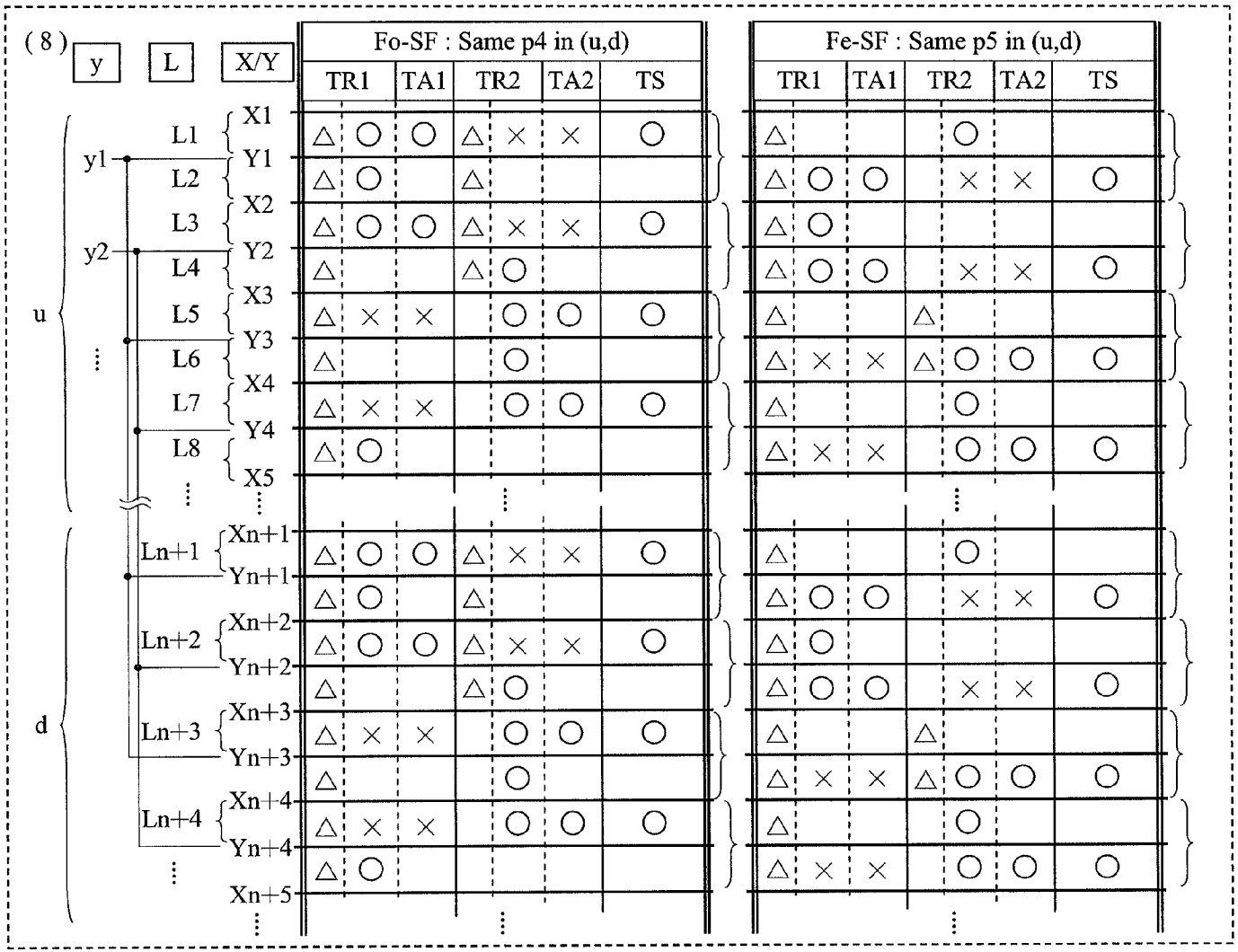
FIG. 24 is a diagram showing control objects and timings in a driving method of a PDP apparatus according to the eighth embodiment of the present invention.

Next, an eighth embodiment of the present invention will be described with reference to FIG. 24 and others. FIG. 24 shows the outline of driving control in the eighth embodiment. The eighth embodiment is different from the seventh embodiment in that it has the double A structure and the Y common connection structure (D). In the structure of the eighth embodiment, on the basis of the background structure 8, the same Y common connection structure (D) as that in the fourth embodiment is used, and as the corresponding voltage waveform, the patterns (p4, p5) shown in FIG. 22 and FIG. 23 are applied in (u, d) in the same manner.

<Driving Control (8)>

In FIG. 24, as an example, some of initial lines of Ls in (u, d), that is, L (L1 to L4, Ln+1 to Ln+4) are shown. With regard to details of drive waveforms, the same waveforms as those of p4 and p5 in the seventh embodiment are repeated in (u, d), respectively. The voltage waveforms: VAu and VAd similar to those of VA are applied to Au and Ad.

In the PDP (ALIS and interlace driving method) of the background structure 8, it has the alternate arrangement structure of X and Y and the double A structure, and it uses the SSP. As shown in FIG. 5, as the Y common connection structure, two lines of Ys in every other Y in the area u and two lines of Ys in every other Y at corresponding positions in the area d, that is, total of four Ys are connected to wiring y. For example, (Y1 and Y3) and (Yn+1 and Yn+3) are connected to y1 to form a set unit. For the y formed over the areas (u, d), in the same manner as that in the seventh embodiment by use of interlace driving method, the drive display is performed while switching the positive and reverse Ls (Lo, Le) for each Fo and Fe.

As described above, according to the eighth embodiment, the number of Y bits is reduced to ¼ from k/2 to k/8 in comparison with the background structure 8.

As described heretofore, according to the embodiments, by the adjustments for the driving method (in particular, driving voltage waveform) and connection portion structure between a PDP and drivers, the number of Y bits can be reduced to approximately half or ¼ from the conventional technology without making the large modification in hardware structure. Owing to the reduction in the numbers of Y bits, the size and costs of an apparatus can be reduced particularly by a Y connection portion and Y driver and others.

In the foregoing, the invention made by the inventors of the present invention has been concretely described based on the embodiments. However, it is needless to say that the present invention is not limited to the foregoing embodiments and various modifications and alterations can be made within the scope of the present invention.

What is claimed is:

1. A plasma display apparatus comprising:

a plasma display panel in which display electrodes extending approximately in parallel to a first direction and forming discharge gaps in a second direction are arranged on a first substrate and address electrodes extending approximately in parallel to the second direction are arranged on a second substrate opposite to the first substrate, and scan electrodes used for scan and sustain electrodes not used for the scan are arranged adjacently as the display electrodes, and display lines are formed of pairs of the adjacent scan electrodes and sustain electrodes, and display cells are formed at corresponding areas where the display lines and the address electrodes cross to each other;

a first driving circuit which applies voltage waveforms for driving to the sustain electrodes;

a second driving circuit which applies voltage waveforms for driving to the scan electrodes;

a third driving circuit which applies voltage waveforms for driving to the address electrodes; and a control circuit which controls the respective driving circuits, wherein:

in driving control by application of voltage waveforms from the respective driving circuits in a specified unit of time for display, a reset operation to be preparation for an address operation, the address operation to select the display cells to be lit, and a sustain operation to perform a sustain discharge in the display cells selected in the address operation are performed, in the display electrodes, two adjacent scan electrodes and two adjacent sustain electrodes are sequentially and repeatedly arranged in the second direction, the two scan electrodes are commonly connected in the vicinity of a connection portion between the plasma display panel and the second driving circuit, and one voltage waveform is applied to the commonly-connected two adjacent scan electrodes from the second driving circuit, and the two adjacent sustain electrodes are not commonly connected and respectively different driving waveforms are applied thereto, a period in which the reset operation and the address operation are performed is divided into two periods, the first driving circuit applies the same voltage waveform to one sustain electrode which forms the display cell together with one scan electrode of the two adjacent scan electrodes and to the other sustain electrode which forms the display cell together with the other scan electrode of the two adjacent scan electrodes in one period of the two periods of the one sustain electrode and the other period of the two periods of the other sustain electrode, and the first driving circuit applies, to one of the sustain electrodes, a voltage waveform having a different voltage value at least in a period when the address operation is performed in the one period and the other period, and in the sustain operation, the first driving circuit and the second driving circuit apply sustain pulses having different phases and equal amplitude value to the sustain electrodes and the scan electrodes.

2. The plasma display apparatus according to claim 1, wherein the commonly-connected two adjacent scan electrodes are commonly connected by a wiring of a flexible printed circuit board which connects the plasma display panel and an IC board of the second driving circuit, or by a wiring in an end area of the IC board of the second driving circuit.

3. A plasma display apparatus comprising:

a plasma display panel in which display electrodes, including scan electrodes and sustain electrodes, extending approximately in parallel to a first direction and forming discharge gaps in a second direction are arranged on a first substrate; address electrodes extending approximately in parallel to the second direction are arranged on a second substrate opposite to the first substrate; display lines are formed of pairs of the adjacent scan electrodes and sustain electrodes; and display cells are formed at corresponding areas where the display lines and the address electrodes cross to each other;

a first driving circuit which applies voltage waveforms for driving to the sustain electrodes;

a second driving circuit which applies voltage waveforms for driving to the scan electrodes;

a third driving circuit which applies voltage waveforms for driving to the address electrodes; and a control circuit which controls the first, second and third driving circuits, wherein:

in the display electrodes, two adjacent scan electrodes and two adjacent sustain electrodes are sequentially and repeatedly arranged in the second direction, the two adjacent scan electrodes are commonly connected in the vicinity of a connection portion between the plasma display panel and the second driving circuit, and one voltage waveform is applied to the commonly-connected two scan electrodes from the second driving circuit, and the two adjacent sustain electrodes are not commonly connected and respectively different driving waveforms are applied thereto, and the first driving circuit applies the same voltage waveform in one period of the two periods of the one sustain electrode and the other period of the two periods of the other sustain electrode, and applies, to one of the sustain electrodes, a voltage waveform having a different voltage value at least in a period when an address operation is performed in the one period and the other period to select display cells in the plasma display panel.

4. The plasma display apparatus according to claim 3, wherein the commonly-connected two adjacent scan electrodes are commonly connected by a wiring of a flexible printed circuit board which connects the plasma display panel and an IC board of the second driving circuit.

5. The plasma display apparatus according to claim 3, wherein the commonly-connected two adjacent scan electrodes are commonly connected by a wiring in an end area of an IC board of the second driving circuit.

* * * * *